US008823604B2

(12) United States Patent
Yamashita et al.

(10) Patent No.: US 8,823,604 B2
(45) Date of Patent: Sep. 2, 2014

(54) DISPLAY DEVICE, METHOD FOR DRIVING THE SAME, AND ELECTRONIC APPARATUS

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1330 days.

(21) Appl. No.: 12/289,126

(22) Filed: Oct. 21, 2008

(65) Prior Publication Data

US 2009/0121974 A1 May 14, 2009

(30) Foreign Application Priority Data

Nov. 14, 2007 (JP) ..... 2007-295554

(51) Int. Cl.
*G09G 3/20* (2006.01)
*G09G 3/32* (2006.01)

(52) U.S. Cl.
CPC ..... *G09G 3/3233* (2013.01); *G09G 2300/0819* (2013.01); *G09G 3/3291* (2013.01); *G09G 2310/0256* (2013.01); *G09G 3/3266* (2013.01); *G09G 2300/0842* (2013.01); *G90G 2300/0861* (2013.01); *Y10S 345/904* (2013.01)
USPC ..... 345/55; 345/13; 345/77; 345/204; 345/904

(58) Field of Classification Search
None
See application file for complete search history.

(56) References Cited

U.S. PATENT DOCUMENTS

| | | | | |
|---|---|---|---|---|
| 6,552,705 | B1 * | 4/2003 | Hirota | 345/92 |
| 7,057,588 | B2 | 6/2006 | Asano et al. | |
| 7,102,202 | B2 | 9/2006 | Kobayashi et al. | |
| 7,109,952 | B2 | 9/2006 | Kwon et al. | |
| 2005/0083319 | A1 * | 4/2005 | Kodate et al. | 345/204 |
| 2005/0206590 | A1 | 9/2005 | Sasaki et al. | |
| 2006/0170628 | A1 * | 8/2006 | Yamashita et al. | 345/76 |
| 2007/0115224 | A1 * | 5/2007 | Yamamoto et al. | 345/76 |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |
| JP | 2004-133240 | A | 4/2004 |
| JP | 2006-215213 | | 8/2006 |

* cited by examiner

*Primary Examiner* — Jesus Hernandez
(74) *Attorney, Agent, or Firm* — Rader, Fishman & Grauer PLLC

(57) ABSTRACT

Disclosed herein is a display device including: a pixel array part configured to include scan lines disposed along rows, signal lines disposed along columns, and pixels that are disposed at intersections of the scan lines and the signal lines and are arranged in a matrix; and a drive part configured to have at least a write scanner that sequentially supplies a control signal to the scan lines to thereby carry out line-sequential scanning and a signal selector that supplies a video signal to the signal lines in matching with the line-sequential scanning.

5 Claims, 31 Drawing Sheets

$$Ids=k\mu(Vgs-Vth)^2=k\mu(Vsig-\Delta V)^2$$

FIRST MOBILITY CORRECTION PERIOD

CORRECTION INTERMEDIATE PERIOD $\Delta V1 = Ids \cdot t/C$

SECOND MOBILITY CORRECTION PERIOD $\Delta V2$ IS DETERMINED BY EQUATION 5 ABOUT MOBILITY CORRECTION

DISPLAY DEVICE, METHOD FOR DRIVING THE SAME, AND ELECTRONIC APPARATUS

CROSS REFERENCES TO RELATED APPLICATIONS

The present invention contains subject matter related to Japanese Patent Application JP 2007-295554 filed in the Japan Patent Office on Nov. 14, 2007, the entire contents of which being incorporated herein by reference.

BACKGROUND OF THE INVENTION

1. Field of the Invention

The present invention relates to a display device in which light-emitting elements provided on a pixel-by-pixel basis are driven by current for image displaying, and a method for driving the same. Furthermore, the present invention relates to electronic apparatus including the display device. Specifically, the present invention relates to a drive system for a so-called active-matrix display device in which the amount of the current applied to a light-emitting element, such as an organic EL (electro-luminescence) element, is controlled by insulated-gate field effect transistors provided in each pixel circuit.

2. Description of the Related Art

In a display device, e.g., in a liquid crystal display, a large number of liquid crystal pixels are arranged in a matrix, and the transmittance intensity or the reflection intensity of incident light is controlled on a pixel-by-pixel basis in accordance with information on an image to be displayed, to thereby display the image. This pixel-by-pixel control is carried out also in an organic EL display employing organic EL elements for its pixels. The organic EL element however is a self-luminous element unlike the liquid crystal pixel. Therefore, the organic EL display has the following advantages over the liquid crystal display: higher image visibility, no necessity for a backlight, and higher response speed. Furthermore, the organic EL display is a so-called current-control display, which can control the luminance level (grayscale) of each light-emitting element based on the current that flows through the light-emitting element, and hence is greatly different from a voltage-control display such as the liquid crystal display.

The kinds of drive systems for the organic EL display include a simple-matrix system and an active-matrix system similarly to the liquid crystal display. The simple-matrix system has a simpler structure but involves problems such as difficulty in achievement of a large-size and high-definition display. Therefore, currently, the active-matrix system is being developed more actively. In the active-matrix system, the current that flows through a light-emitting element in each pixel circuit is controlled by an active element (typically a thin film transistor (TFT)) provided in the pixel circuit. Related arts about this system have been disclosed in Japanese Patent Laid-open Nos. 2003-255856, 2003-271095, 2004-133240, 2004-029791, 2004-093682, and 2006-215213.

SUMMARY OF THE INVENTION

The pixel circuit in the related art is disposed at each of the intersections of scan lines along the rows for supplying a control signal and signal lines along the columns for supplying a video signal. Each pixel circuit includes at least a sampling transistor, a holding capacitor, a drive transistor and a light-emitting element. The sampling transistor is turned on in response to the control signal supplied from the scan line, to thereby sample the video signal supplied from the signal line. The holding capacitor holds an input voltage dependent upon the signal potential of the sampled video signal. The drive transistor supplies an output current as a drive current during a predetermined light-emission period depending on the input voltage held by the holding capacitor. Typically the output current has dependence on the carrier mobility in the channel region of the drive transistor and the threshold voltage of the drive transistor. The output current supplied from the drive transistor causes the light-emitting element to emit light with the luminance dependent upon the video signal.

The drive transistor receives the input voltage held by the holding capacitor at its gate as a control terminal thereof, and allows the passage of the output current between its source and drain as a pair of current terminals thereof, to thereby apply the current to the light-emitting element. Typically the light-emission luminance of the light-emitting element is proportional to the applied current amount. In addition, the amount of the output current supplied from the drive transistor is controlled by the gate voltage, i.e., the input voltage written to the holding capacitor. The related-art pixel circuit changes the input voltage applied to the gate of the drive transistor depending on the input video signal, to thereby control the amount of the current supplied to the light-emitting element.

The operating characteristic of the drive transistor is represented by Equation 1.

$$Ids=(1/2)\mu(W/L)Cox(Vgs-Vth)^2 \quad \text{Equation 1}$$

In Equation 1, Ids denotes the drain current that flows between the source and the drain. This current is equivalent to the output current supplied to the light-emitting element in the pixel circuit. Vgs denotes the gate voltage applied to the gate relative to the source. The gate voltage is equivalent to the above-described input voltage in the pixel circuit. Vth denotes the threshold voltage of the transistor. μ denotes the mobility in the semiconductor thin film serving as the channel of the transistor. W, L and Cox denote the channel width, the channel length and the gate capacitance, respectively. As is apparent from Equation 1 as a transistor characteristic equation, when a thin film transistor operates in its saturation region, the transistor enters the on-state and thus the drain current Ids flows therethrough if the gate voltage Vgs surpasses the threshold voltage Vth. In principle, a constant gate voltage Vgs invariably supplies the same drain current Ids to the light-emitting element as shown by Equation 1. Therefore, supplying the video signal of the same level to all of the pixels in the screen will allow all of the pixels to emit light with the same luminance, and thus will offer the uniformity of the screen.

However, actual thin film transistors (TFT) formed of a semiconductor thin film such as a poly-silicon film involve variation in the device characteristics. In particular, the threshold voltage Vth is not constant but varies from pixel to pixel. As is apparent from Equation 1, even if the gate voltage Vgs is constant, variation in the threshold voltage Vth among the respective drive transistors leads to variation in the drain current Ids. Thus, the luminance varies from pixel to pixel, which spoils the uniformity of the screen. As a related art, there has been developed a pixel circuit that has a function to cancel variation in the threshold voltage among the drive transistors. For example, this pixel circuit is disclosed in the above-mentioned Japanese Patent Laid-open No. 2004-133240.

However, the threshold voltage Vth of the drive transistor is not the only one factor in variation in the output current to the light-emitting element. As is apparent from Equation 1, the output current Ids varies also when the mobility μ of the drive transistor varies. As a result, the uniformity of the screen is spoiled. As a related art, there has been developed a pixel circuit that has a function to correct variation in the mobility of the drive transistor. For example, this pixel circuit is disclosed in the above-mentioned Japanese Patent Laid-open No. 2006-215213.

The related-art pixel circuit having the mobility correction function carries out negative feedback of the drive current, which flows through the drive transistor depending on the signal potential, to the holding capacitor during a predetermined correction period, to thereby adjust the signal potential held in the holding capacitor. When the mobility of the drive transistor is high, the negative feedback amount is correspondingly large and thus the decrease width of the signal potential is large. As a result, the drive current can be suppressed. On the other hand, when the mobility of the drive transistor is low, the amount of the negative feedback to the holding capacitor is small and therefore the decrease width of the held signal potential is small. Thus, the drive current is not greatly decreased. In this manner, depending on the mobility of the drive transistor in each pixel, the signal potential is so adjusted that the mobility difference is cancelled. Consequently, although there is variation in the mobility among the drive transistors in the respective pixels, the respective pixels offer the light-emission luminance of the same level for the same signal potential.

The above-described mobility correction operation is carried out during a predetermined mobility correction period. In an active-matrix display device, a respective one of the pixel rows is line-sequentially scanned every one horizontal scanning period. In the active-matrix display device, the above-described threshold voltage correction operation, signal writing operation, and mobility correction operation need to be carried out within one horizontal scanning period. As enhancement in the pixel density or the definition in the active-matrix display device is advanced, the length of one horizontal scanning period allocated to each pixel row is shortened. The mobility correction time tends to be also shortened along with the shortening of one horizontal scanning period. The related-art display device will be incompatible with the shortening of the mobility correction period and thus be unable to sufficiently carry out the mobility correction. This is a problem that should be solved.

In order to enhance the uniformity of the screen, it is important to carry out the mobility correction under the optimum condition. However, the optimum mobility correction time is not necessarily constant but depends on the level of the video signal in practice. In general, when the signal potential of the video signal is high (when the light-emission luminance is high for white displaying), the optimum mobility correction time tends to be short. In contrast, when the signal potential is not high (when displaying of a gray or black level is carried out), the optimum mobility correction time tends to be long. However, for the related-art display device, the dependence of the optimum mobility correction time on the signal potential of the video signal is not necessarily taken into consideration, which is a problem that should be solved to enhance the uniformity of the screen.

There is a need for the present invention to provide a display device that can accelerate mobility correction operation so that mobility correction can be carried out in a short time. There is another need for the present invention to provide a display device that can adjust a mobility correction period depending on the grayscale (signal level) of a video signal. According to a first mode of the present invention, there is provided a display device including a pixel array part configured to include scan lines disposed along rows, signal lines disposed along columns, and pixels that are disposed at the intersections of the scan lines and the signal lines and are arranged in a matrix, and a drive part configured to have at least a write scanner that sequentially supplies a control signal to the scan lines to thereby carry out line-sequential scanning and a signal selector that supplies a video signal to the signal lines in matching with the line-sequential scanning. Each of the pixels includes at least a sampling transistor, a drive transistor, a holding capacitor, and a light-emitting element. A control terminal of the sampling transistor is connected to the scan line, and a pair of current terminals of the sampling transistor are connected between the signal line and a control terminal of the drive transistor. One of a pair of current terminals of the drive transistor is connected to the light-emitting element, and the other of the pair of current terminals of the drive transistor is connected to a power supply. The holding capacitor is connected between the control terminal of the drive transistor and the current terminal of the drive transistor. The sampling transistor is turned on in response to a control signal supplied to the scan line to thereby sample a video signal from the signal line and write the video signal to the holding capacitor, and the sampling transistor carries out negative feedback of a current that flows from the drive transistor to the holding capacitor to thereby write a correction amount dependent upon the mobility of the drive transistor to the holding capacitor in a predetermined correction period until the sampling transistor is turned off in response to a control signal. The drive transistor supplies, to the light-emitting element, a current dependent upon the video signal and the correction amount written to the holding capacitor to thereby cause the light-emitting element to emit light. The write scanner supplies a control signal including at least double pulses to the scan line to thereby set a first correction period, a second correction period, and a correction intermediate period between the first correction period and the second correction period. The sampling transistor carries out writing of a correction amount to the holding capacitor in the first correction period and accelerates the writing of the correction amount to the holding capacitor in the correction intermediate period, and the sampling transistor settles the writing of the correction amount to the holding capacitor in the second correction period.

According to a second mode of the present invention, there is provided a display device including a pixel array part configured to include scan lines disposed along rows, signal lines disposed along columns, and pixels that are disposed at the intersections of the scan lines and the signal lines and are arranged in a matrix, and a drive part configured to have at least a write scanner that sequentially supplies a control signal to the scan lines to thereby carry out line-sequential scanning and a signal selector that supplies a video signal to the signal lines in matching with the line-sequential scanning. Each of the pixels includes at least a sampling transistor, a drive transistor, a holding capacitor, and a light-emitting element. A control terminal of the sampling transistor is connected to the scan line, and a pair of current terminals of the sampling transistor are connected between the signal line and a control terminal of the drive transistor. One of a pair of current terminals of the drive transistor is connected to the light-emitting element, and the other of the pair of current terminals of the drive transistor is connected to a power supply. The holding capacitor is connected between the control terminal of the drive transistor and the current terminal of the drive transistor. The sampling transistor is turned on in response to a control signal supplied to the scan line to thereby sample a video signal from the signal line and write the video signal to the holding capacitor, and the sampling transistor carries out negative feedback of a current that flows from the drive transistor to the holding capacitor to thereby write a correction amount dependent upon the mobility of the drive transistor to the holding capacitor in a predetermined correction period until the sampling transistor is turned off in response to a control signal. The drive transistor supplies, to the light-emitting element, a current dependent upon the video signal and the correction amount written to the holding capacitor to thereby cause the light-emitting element to emit light. The write scanner supplies, to the scan line, a control signal including at least double pulses having peak levels different from each other. The sampling transistor is turned on and off in accordance with the peak levels of the double pulses applied to the control terminal of the sampling transistor as the gate of the sampling transistor depending on the level of a video signal applied to the current terminal of the sampling transistor as the source of the sampling transistor, to thereby automatically adjust a correction time depending on the level of the video signal.

According to the first mode of the present invention, the write scanner supplies a control signal including double pulses to the scan line to thereby set the first correction period, the second correction period, and the correction intermediate period between these correction periods. The sampling transistor carries out writing of a correction amount to the holding capacitor in the first correction period, and accelerates the writing of the correction amount to the holding capacitor in the correction intermediate period. Furthermore, the sampling transistor settles the writing of the correction amount to the holding capacitor in the second correction period. In this manner, the correction period is divided into at least the former period and the latter period, and the writing of the correction amount is accelerated in the correction intermediate period between the former and latter periods. This feature allows shortening of the entire correction time, which can provide compatibility with enhancement in the definition and the pixel density of the display device.

According to the second mode of the present invention, the write scanner supplies, to the scan line, a control signal including at least double pulses having peak levels different from each other. The sampling transistor is turned on and off in accordance with the peak levels of the double pulses applied to the gate thereof depending on the level of the video signal applied to the source thereof, to thereby automatically adjust the mobility correction time depending on the level of the video signal. This feature makes it possible to automatically adjust the mobility correction time to the optimum time depending on the level of the video signal, and thus can achieve image displaying with high uniformity for all of the grayscales of the video signal.

DETAILED DESCRIPTION OF THE PREFERRED EMBODIMENTS

Figure 1:
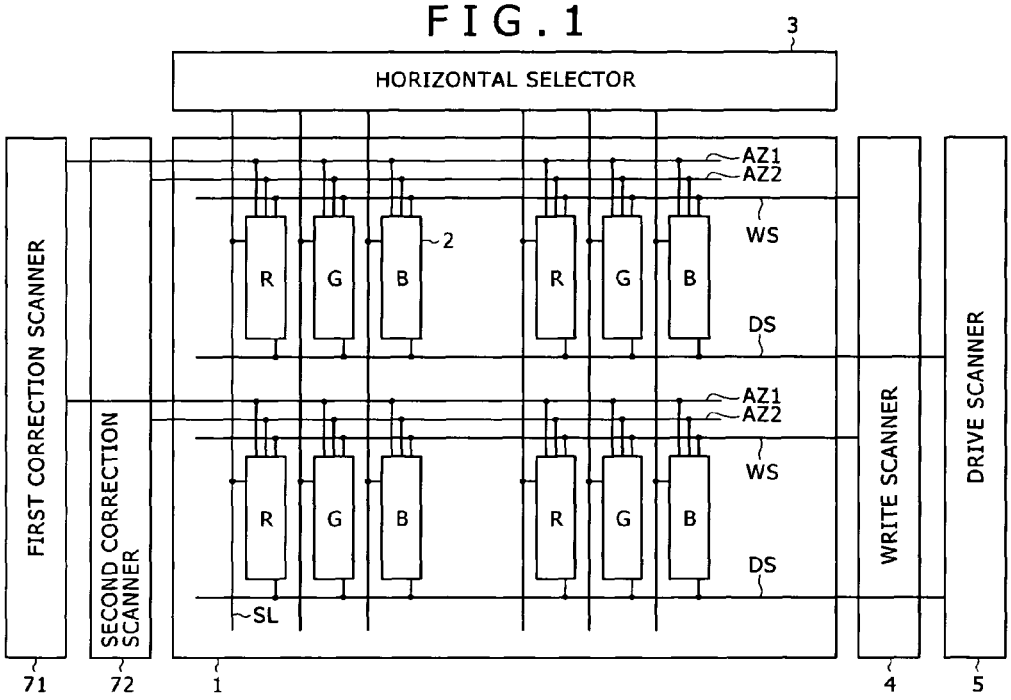
FIG. 1 is a block diagram showing the entire configuration of a display device according to an embodiment of the present invention.

Embodiments of the present invention will be described below in detail with reference to the accompanying drawings. FIG. 1 is a block diagram showing the entire configuration of a display device according to an embodiment of the present invention. As shown in FIG. 1, this display device is basically composed of a pixel array part 1, a scanner part, and a signal part. The scanner part and the signal part serve as a drive part. The pixel array part 1 includes first scan lines WS, second scan lines DS, third scan lines AZ1, and fourth scan lines AZ2 that are disposed along the rows, and signal lines SL disposed along the columns. Furthermore, the pixel array part 1 includes pixel circuits 2 that are arranged in a matrix and are each connected to the scan lines WS, DS, AZ1, and AZ2, and the signal line SL. In addition, the pixel array part 1 includes plural power supply lines for supplying a first potential Vss1, a second potential Vss2, and a third potential VDD necessary for the operation of the respective pixel circuits 2. The signal part is formed of a horizontal selector 3 and supplies a video signal to the signal lines SL. The scanner part is composed of a write scanner 4, a drive scanner 5, a first correction scanner 71, and a second correction scanner 72 that supply control signals to the first scan lines WS, the second scan lines DS, the third scan lines AZ1, and the fourth scan lines AZ2, respectively, for sequential scanning of the pixel circuits 2 on a row-by-row basis.

Figure 2:
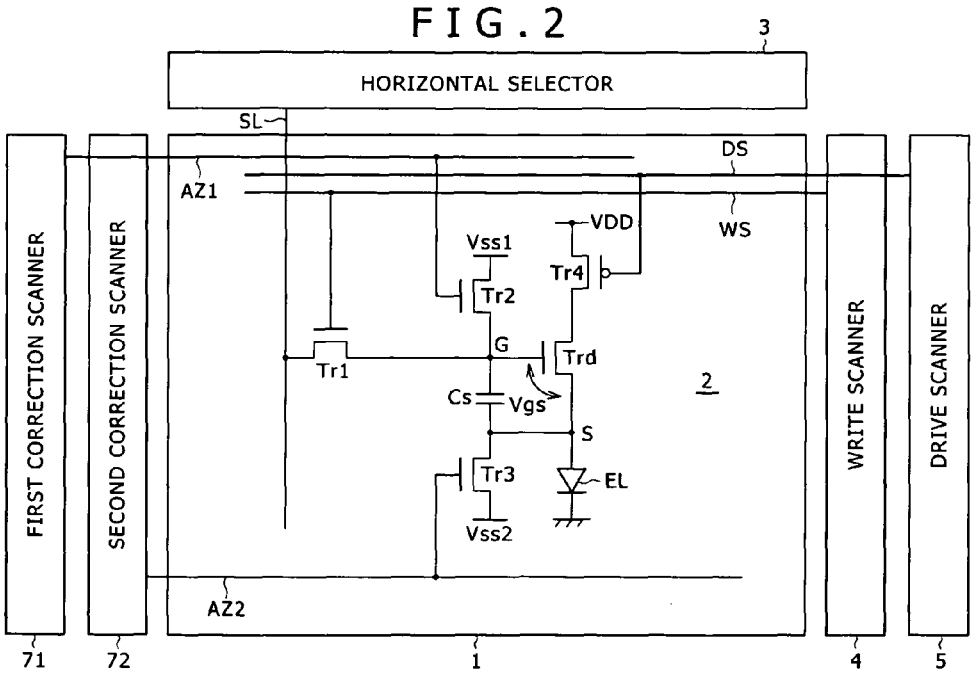
FIG. 2 is a circuit diagram showing the configuration of a pixel included in the display device shown in FIG. 1.

FIG. 2 is a circuit diagram showing the configuration of the pixel incorporated in the image display device shown in FIG. 1. As shown in FIG. 2, the pixel circuit 2 includes a sampling transistor Tr1, a drive transistor Trd, a first switching transistor Tr2, a second switching transistor Tr3, a third switching transistor Tr4, a holding capacitor Cs, and a light-emitting element EL. The sampling transistor Tr1 is turned on in response to the control signal supplied from the scan line WS during a predetermined sampling period, to thereby sample the signal potential of the video signal supplied from the signal line SL in the holding capacitor Cs. The holding capacitor Cs applies an input voltage Vgs to the gate G of the drive transistor Trd depending on the sampled signal potential of the video signal. The drive transistor Trd supplies an output current Ids dependent upon the input voltage Vgs to the light-emitting element EL. The output current Ids supplied from the drive transistor Trd during a predetermined light-emission period causes the light-emitting element EL to emit light with the luminance dependent upon the signal potential of the video signal.

The first switching transistor Tr2 is turned on in response to the control signal supplied from the scan line AZ1 before the sampling period (video signal writing period), to thereby set the potential of the gate G as the control terminal of the drive transistor Trd to the first potential Vss1. The second switching transistor Tr3 is turned on in response to the control signal supplied from the scan line AZ2 before the sampling period, to thereby set the potential of the source S of the drive transistor Trd as one of the current terminals of the drive transistor Trd to the second potential Vss2. The third switching transistor Tr4 is turned on in response to the control signal supplied from the scan line DS before the sampling period, to thereby couple the drain of the drive transistor Trd as the other of the current terminals of the drive transistor Trd to the third potential VDD. This causes the holding capacitor Cs to hold the voltage equivalent to the threshold voltage Vth of the drive transistor Trd to thereby correct the influence of the threshold voltage Vth. In addition, this third switching transistor Tr4 is turned on in response to the control signal supplied from the scan line DS again during a light-emission period, to thereby couple the drive transistor Trd to the third potential VDD. This allows the output current Ids to flow to the light-emitting element EL.

As is apparent from the above description, the pixel circuit 2 includes five transistors Tr1 to Tr4 and Trd, one holding capacitor Cs, and one light-emitting element EL. The transistors Tr1 to Tr3 and Trd are each an N-channel poly-silicon TFT. Only the transistor Tr4 is a P-channel poly-silicon TFT. However, the present invention is not limited thereto but N-channel TFTs and P-channel TFTs may be mixed in any manner. The light-emitting element EL is e.g. a diode-type organic EL device having an anode and a cathode. However, the present invention is not limited thereto but the light-emitting element encompasses all general devices that emit light through driving by current.

Figure 3:
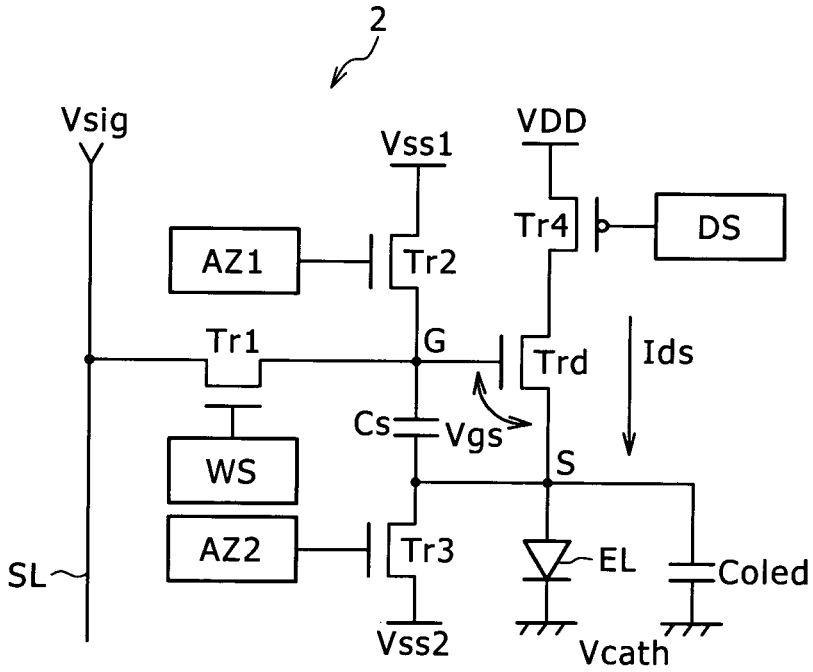
FIG. 3 is a circuit diagram for explaining the operation of the pixel shown in FIG. 2.

FIG. 3 is a schematic diagram focusing only on the part of the pixel circuit 2 in the image display device shown in FIG. 2. In order to facilitate understanding, FIG. 3 includes representation of the signal potential Vsig of the video signal sampled by the sampling transistor Tr1, the input voltage Vgs and the output current Ids of the drive transistor Trd, and a capacitive component Coled possessed by the light-emitting element EL. The operation of the pixel circuit 2 relating to the embodiments of the present invention will be described below based on FIG. 3.

Figure 4:
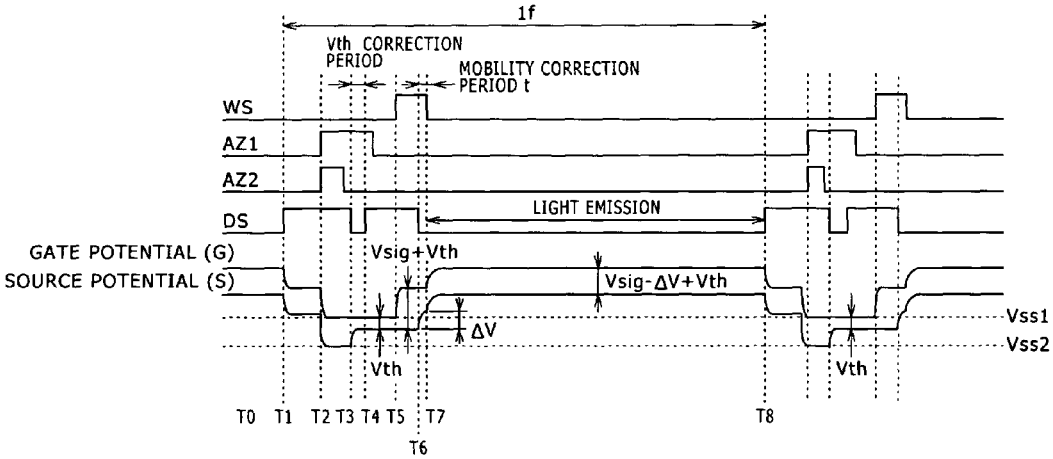
FIG. 4 is a reference timing chart for explaining the operation of the display device shown in FIGS. 1 and 2.

FIG. 4 is a timing chart about the pixel circuit shown in FIG. 3. This timing chart shows a drive system relating to a related-art technique as the basis of the embodiments of the present invention. In order to clearly show the background of the present invention and facilitate understanding, initially the drive system of this related-art technique will be specifically described below as a part of the embodiments of the present invention, with reference to the timing chart of FIG. 4. In FIG. 4, the waveforms of the control signals applied to the respective scan lines WS, AZ1, AZ2, and DS are shown along a time axis T. For simplified description, each control signal is given the same symbol as that of the corresponding scan line. Because the transistors Tr1, Tr2 and Tr3 are each an N-channel transistor, they are in the on-state when the scan lines WS, AZ1, and AZ2 are at the high level, and are in the off-state when these scan lines are at the low level. On the other hand, because the transistor Tr4 is a P-channel transistor, it is in the off-state when the scan line DS is at the high level, and is in the on-state when the scan line DS is at the low level. In this timing chart, potential changes of the gate G and the source S of the drive transistor Trd are also shown in addition to the waveforms of the respective control signals WS, AZ1, AZ2, and DS.

In the timing chart of FIG. 4, the period from a timing T1 to a timing T8 is defined as one field (1*f*). In one field, each row of the pixel array is sequentially scanned one time. In the timing chart, the waveforms of the respective control signals WS, AZ1, AZ2, and DS applied to the pixels on one row are shown.

At a timing T0, which is prior to the start of the description-subject field, all of the control signals WS, AZ1, AZ2, and DS are at the low level. Therefore, the N-channel transistors Tr1, Tr2, and Tr3 are in the off-state whereas only the P-channel transistor Tr4 is in the on-state. Thus, the drive transistor Trd is coupled to the power supply VDD via the transistor Tr4 in the on-state, and therefore supplies the output current Ids to the light-emitting element EL depending on the predetermined input voltage Vgs. Consequently, the light-emitting element EL emits light at the timing T0. The input voltage Vgs applied at this time to the drive transistor Trd is represented as the potential difference between the gate potential (G) and the source potential (S).

At the timing T1, which is the start of the description-subject field, the control signal DS is switched from the low level to the high level. This turns off the switching transistor Tr4, which isolates the drive transistor Trd from the power supply VDD. Thus, the light emission is stopped and a non-light-emission period starts. That is, at the timing T1, all of the transistors Tr1 to Tr4 enter the off-state.

Subsequently, at a timing T2, the control signals AZ1 and AZ2 are switched to the high level, which turns on the switching transistors Tr2 and Tr3. As a result, the gate G of the drive transistor Trd is coupled to the reference potential Vss1, and the source S thereof is coupled to the reference potential Vss2. The potentials Vss1 and Vss2 satisfy the relationship Vss1−Vss2>Vth. Therefore, through ensuring of the relationship Vss1−Vss2=Vgs>Vth, preparation for the Vth correction from a timing T3 is carried out. That is, the period T2 to T3 corresponds to the reset period for the drive transistor Trd. Furthermore, the relationship VthEL>Vss2 is designed, in which VthEL denotes the threshold voltage of the light-emitting element EL. Due to this relationship, negative bias is applied to the light-emitting element EL, and therefore the light-emitting element EL is in the so-called reverse-bias state. This reverse-bias state is necessary to normally carry out Vth correction operation and mobility correction operation later.

At the timing T3, the control signal AZ2 is switched to the low level, and thereupon the control signal DS is also switched to the low level. Thus, the transistor Tr3 is turned off while the transistor Tr4 is turned on. As a result, the drain current Ids flows toward the holding capacitor Cs, so that the Vth correction operation is started. During the current flow, the potential of the gate G of the drive transistor Trd is kept at Vss1. The current Ids flows until the drive transistor Trd is cut off. At the timing of the cutting-off of the drive transistor Trd, the source potential (S) of the drive transistor Trd is Vss1−Vth. At a timing T4, which is after the cutting-off of the drain current, the control signal DS is returned to the high level again to thereby turn off the switching transistor Tr4. In addition, the control signal AZ1 is returned to the low level to thereby turn off the switching transistor Tr2. As a result, Vth is held and fixed in the holding capacitor Cs. In this manner, the threshold voltage Vth of the drive transistor Trd is detected in the period T3 to T4. In the present specification, the detection period T3 to T4 is referred to as a Vth correction period.

After the Vth correction is thus carried out, the control signal WS is switched to the high level at a timing T5. Thus, the sampling transistor Tr1 is tuned on to thereby write the video signal Vsig to the holding capacitor Cs. The capacitance of the holding capacitor Cs is sufficiently lower than that of the equivalent capacitor Coled of the light-emitting element EL. Consequently, most of the video signal Vsig is written to the holding capacitor Cs. To be exact, the potential difference Vsig−Vss1 is written to the holding capacitor Cs. Therefore, the voltage Vgs between the gate G and the source S of the drive transistor Trd becomes the voltage (Vsig−Vss1+Vth), which results from the addition of the sampled voltage Vsig−Vss1 to the voltage Vth detected and held in advance. If the relationship Vss1=0 V is employed in order to simplify the following description, the gate-source voltage Vgs is Vsig+Vth as shown in the timing chart of FIG. 4. This sampling of the video signal Vsig is carried out until a timing T7, at which the control signal WS is returned to the low level. That is, the period T5 to T7 corresponds to the sampling period (video signal writing period).

At a timing T6, which is prior to the timing T7 as the end timing of the sampling period, the control signal DS is switched to the low level, which turns on the switching transistor Tr4. This operation couples the drive transistor Trd to the power supply VDD, so that the operation sequence of the pixel circuit proceeds to a light-emission period from the non-light-emission period. In this way, during the period T6 to T7, in which the sampling transistor Tr1 is still in the on-state and the switching transistor Tr4 is in the on-state, correction relating to the mobility of the drive transistor Trd is carried out. That is, in the present example of a related-art technique, the mobility correction is carried out during the period T6 to T7, in which later part of the sampling period overlaps with beginning part of the light-emission period. In the beginning part of the light-emission period for the mobility correction, in fact, the light-emitting element EL is in the reverse-bias state and therefore emits no light. In this mobility correction period T6 to T7, the drain current Ids flows through the drive transistor Trd in the state in which the gate G of the drive transistor Trd is fixed at the level of the video signal Vsig. If the relationship Vss1−Vth<VthEL is designed in advance, the light-emitting element EL is kept at the reverse-bias state and therefore exhibits not a diode characteristic but a simple capacitive characteristic. Consequently, the current Ids, which flows through the drive transistor Trd, is written to the capacitor C=Cs+Coled, resulting from coupling between the holding capacitor Cs and the equivalent capacitor Coled of the light-emitting element EL. This raises the source potential (S) of the drive transistor Trd. This potential rise is indicated by ΔV in the timing chart of FIG. 4. This potential rise by ΔV is eventually equivalent to subtraction of the voltage ΔV from the gate-source voltage Vgs held in the holding capacitor Cs, and thus is equivalent to negative feedback. By thus carrying out the negative feedback of the output current Ids of the drive transistor Trd to the input voltage Vgs of the same drive transistor Trd, correction for the mobility μ is allowed. The negative feedback amount ΔV can be optimized by adjusting the time width t of the mobility correction period T6 to T7.

At the timing T7, the control signal WS is switched to the low level, which turns off the sampling transistor Tr1. As a result, the gate G of the drive transistor Trd is isolated from the signal line SL. Because the application of the video signal Vsig is stopped, the gate potential (G) of the drive transistor Trd is permitted to increase, and therefore rises up together with the source potential (S). During this potential rise, the gate-source voltage Vgs held in the holding capacitor Cs is kept at the value (Vsig−ΔV+Vth). The increase of the source potential (S) eliminates the reverse-bias state of the light-emitting element EL in due course. Therefore, the light-emitting element EL starts actual light emission due to the flowing of the output current Ids thereto. The relationship at this time between the drain current Ids and the gate voltage Vgs is represented by Equation 2, which is obtained by substituting Vsig−ΔV+Vth for Vgs in Equation 1.

$$Ids=k\mu(Vgs-Vth)^2=k\mu(Vsig-\Delta V)^2 \quad \text{Equation 2}$$

In Equation 2, k=(½)(W/L)Cox. Equation 2 does not include the term Vth, which means that the output current Ids supplied to the light-emitting element EL has no dependence on the threshold voltage Vth of the drive transistor Trd. Basically, the drain current Ids is determined by the signal voltage Vsig of the video signal. That is, the light-emitting element EL emits light with the luminance dependent upon the video signal Vsig. This voltage Vsig results from the correction by the negative feedback amount ΔV. This correction amount ΔV functions to cancel the influence of the mobility μ, which exists at the coefficient part of Equation 2. Consequently, the drain current Ids depends only on the video signal Vsig practically.

Finally, at the timing T8, the control signal DS is switched to the high level and thus the switching transistor Tr4 is turned off, so that the light emission and the description-subject field finish. Simultaneously the next field starts, so that the Vth correction operation, the mobility correction operation, and the light-emission operation will be repeated again.

Figure 5:
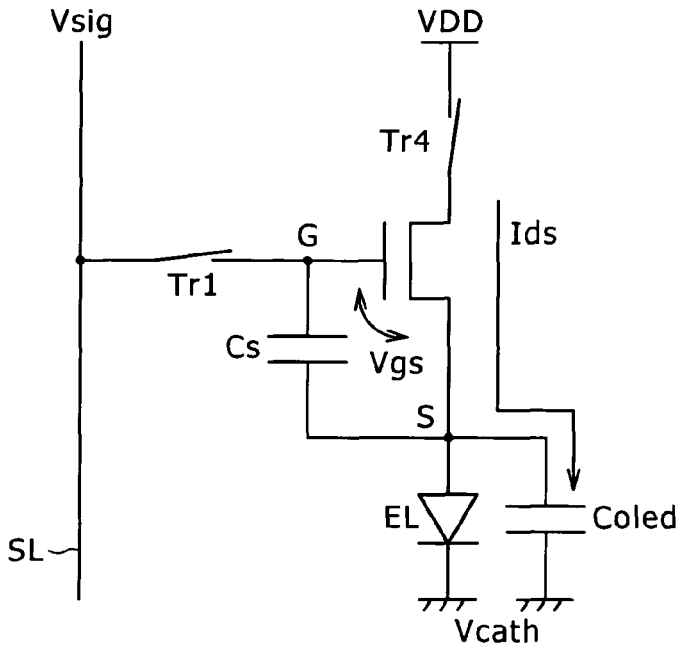
FIG. 5 is a circuit diagram for explaining the operation of the display device shown in FIGS. 1 and 2.

FIG. 5 is a circuit diagram showing the state of the pixel circuit 2 in the mobility correction period T6 to T7. As shown in FIG. 5, in the mobility correction period T6 to T7, the sampling transistor Tr1 and the switching transistor Tr4 are in the on-state whereas the switching transistors Tr2 and Tr3 are in the off-state. In this state, the source potential (S) of the drive transistor Tr4 is Vss1−Vth initially. This source potential (S) is equivalent to the anode potential of the light-emitting element EL. As described above, if the relationship Vss1−Vth<VthEL is designed in advance, the light-emitting element EL is kept at the reverse-bias state and therefore exhibits not a diode characteristic but a simple capacitive characteristic. Thus, the current Ids, which flows through the drive transistor Trd, flows into the synthetic capacitor between the holding capacitor Cs and the equivalent capacitor Coled of the light-emitting element EL, i.e., flows into the capacitor C=Cs+Coled. That is, negative feedback of part of the drain current Ids to the holding capacitor Cs occurs, which offers the correction for the mobility.

Figure 6:
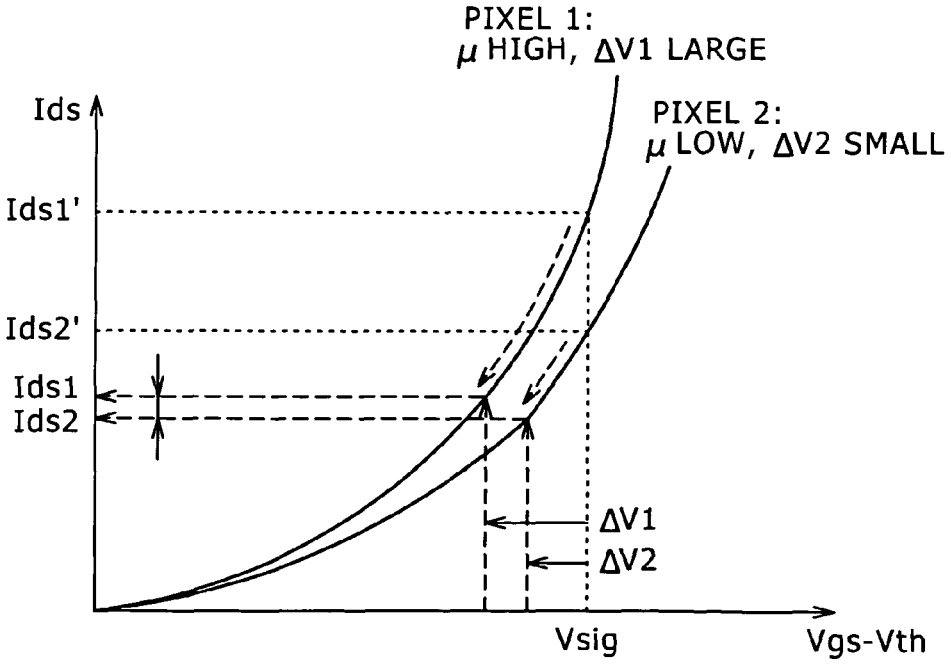
FIG. 6 is a graph for explaining the operation of the display device shown in FIGS. 1 and 2.

FIG. 6 is a graph showing Equation 2. The output current Ids is plotted on the ordinate and the voltage Vsig is plotted on the abscissa. Equation 2 is represented below this graph. The graph of FIG. 6 indicates two characteristic curves as comparison between Pixel 1 and Pixel 2. The mobility μ of the drive transistor in Pixel 1 is relatively high. In contrast, the mobility μ of the drive transistor included in Pixel 2 is relatively low. If the drive transistor is formed of a poly-silicon thin film transistor or the like, it is inevitable that the mobility μ thereof varies from pixel to pixel in this manner. If the same signal potential Vsig of the video signal is written to both Pixels 1 and 2 for example, no correction for the mobility results in a large difference between an output current Ids1' that flows in Pixel 1 having high mobility μ and an output current Ids2' that flows in Pixel 2 having low mobility μ. Because the large difference among the output currents Ids arises in this manner attributed to variation in the mobility μ, streak unevenness occurs and thus the uniformity of the screen is spoiled.

In order to address this problem, in the present example of a related-art technique, the variation in the mobility is cancelled through the negative feedback of the output current to the input voltage side. As is apparent from Equation 1, higher mobility provides a larger drain current Ids. Therefore, the higher the mobility is, the larger the negative feedback amount ΔV is. As shown in the graph of FIG. 6, the negative feedback amount ΔV1 of Pixel 1 with high mobility μ is larger than the negative feedback amount ΔV2 of Pixel 2 with low mobility μ. Therefore, the higher mobility μ leads to a larger negative feedback amount, which allows suppression of the variation. Specifically, as shown in FIG. 6, when the correction by ΔV1 is carried out for Pixel 1 with high mobility μ, the output current thereof greatly decreases from Ids1' to Ids1. In contrast, because the correction amount ΔV2 for Pixel 2 with low mobility μ is small, the decrease amount of the output current thereof is not very large: from Ids2' to Ids2. As a result, Ids1 and Ids2 are almost equal, and thus the variation in the mobility is cancelled. This mobility variation canceling is carried out across the entire range of the signal potential Vsig from the black level to the white level, and thus the uniformity of the screen is extremely high. When taken together, if the mobility of Pixel 1 is higher than that of Pixel 2, the correction amount ΔV1 of Pixel 1 is larger than the correction amount ΔV2 of Pixel 2. That is, higher mobility leads to a larger correction amount ΔV and hence a larger decrease amount of the output current Ids. Thus, the current values of the pixels involving the difference in the mobility are equalized, and therefore the variation in the mobility can be corrected.

For reference, the above-described mobility correction will be numerically analyzed below. This analysis is carried out for the state in which the transistors Tr1 and Tr4 are in the on-state as shown in FIG. 5, and the source potential of the drive transistor Trd is employed as a variable V in this analysis. When the source potential (S) of the drive transistor Trd is defined as V, the drain current Ids following through the drive transistor Trd is represented by Equation 3.

$$I_{ds}=k\mu(V_{gs}-V_{th})^2=k\mu(V_{sig}-V-V_{th})^2 \qquad \text{Equation 3}$$

In addition, the relationship between the drain current Ids and the capacitance C (=Cs+Coled) offers the formula Ids=dQ/dt=CdV/dt as represented by Equation 4.

$$I_{ds}=\frac{dQ}{dt}=C\frac{dV}{dt},\ \int\frac{1}{C}dt=\int\frac{1}{I_{ds}}dV \qquad \text{Equation 4}$$

from $$\Leftrightarrow \int_0^t\frac{1}{C}dt=\int_{-Vth}^{V}\frac{1}{k\mu(V_{sig}-V_{th}-V)^2}dV$$

$$\Leftrightarrow \frac{k\mu}{C}t=\left[\frac{1}{V_{sig}-V_{th}-V}\right]_{-Vth}^{V}=\frac{1}{V_{sig}-V_{th}-V}-\frac{1}{V_{sig}}$$

$$\Leftrightarrow V_{sig}-V_{th}-V=\frac{1}{\frac{1}{V_{sig}}+\frac{k\mu}{C}t}=\frac{V_{sig}}{1+V_{sig}\frac{k\mu}{C}t}$$

Equation 3 is substituted into Equation 4, and then integration of both the sides of the resulting equation is performed. The initial value of the source voltage V is −Vth, and the time width of the mobility variation correction period (T6 to T7) is defined as t. As a result of solving of this differential equation, the pixel current as a function of the mobility correction time t is obtained as represented by Equation 5.

$$I_{ds}=k\mu\left(\frac{V_{sig}}{1+V_{sig}\frac{k\mu}{C}t}\right)^2 \qquad \text{Equation 5}$$

Figure 7:
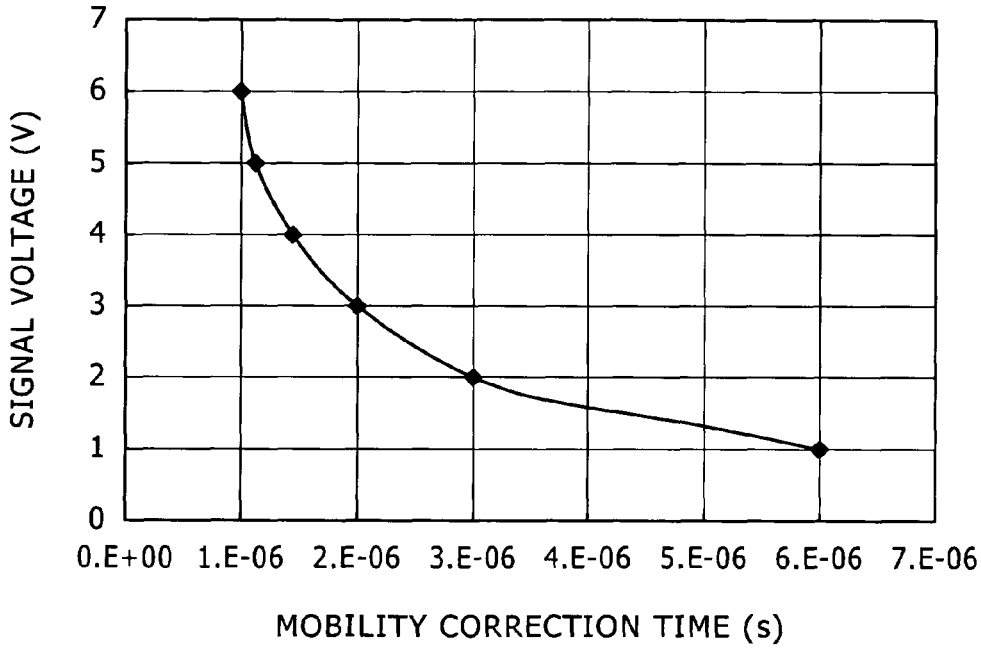
FIG. 7 is a graph for explaining the operation of the display device shown in FIGS. 1 and 2.

Regarding the mobility correction, the optimum mobility correction time is not necessarily constant but changes depending on the signal level (signal voltage) of the video signal. FIG. 7 is a graph showing the relationship between the optimum mobility correction time and the signal voltage. As is apparent from FIG. 7, when the signal voltage is high for the white level, the optimum mobility correction time is comparatively short. When the signal voltage has a value for a gray level, the optimum mobility correction time becomes longer. Furthermore, when the signal voltage has the value for the black level, the optimum mobility correction time tends to be further extended. As described above, the correction amount ΔV of the negative feedback to the holding capacitor during the mobility correction period is proportional to the signal voltage Vsig. When the signal voltage is high, the negative feedback amount is correspondingly large, and therefore the optimum mobility correction time tends to be short. On the other hand, when the signal voltage is lower, the optimum mobility correction time necessary for sufficient correction tends to be longer because the current supply capability of the drive transistor becomes lower.

For this characteristic, a system has been developed in the past in which the timing of turning-off of the sampling transistor Tr1 is so automatically adjusted that the correction time t becomes shorter when the signal potential Vsig of the video signal supplied to the signal line SL is higher and the correction time t becomes longer when the signal potential Vsig of the video signal supplied to the signal line SL is lower.

Figure 8:
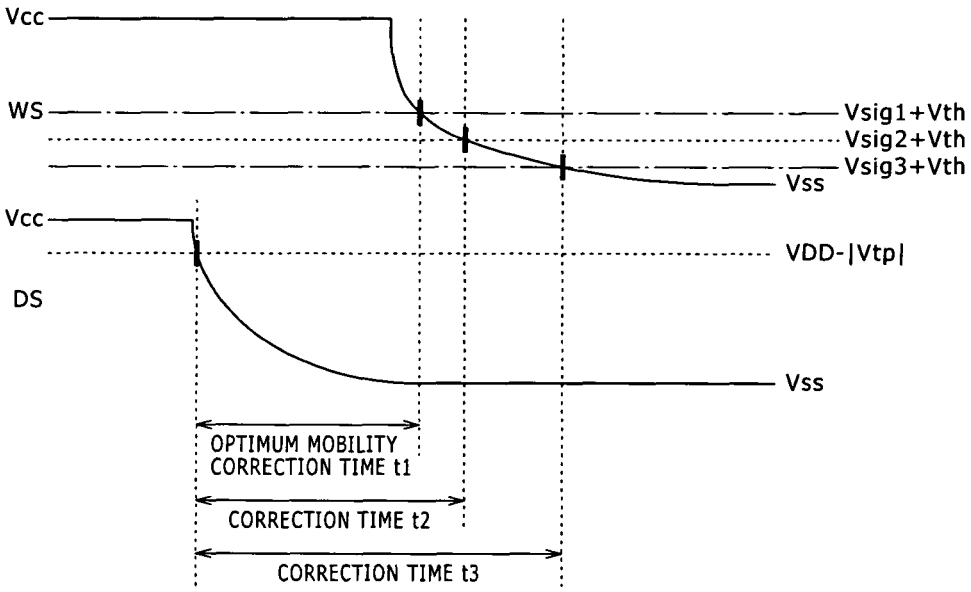
FIG. 8 is a waveform diagram for explaining the operation of the display device shown in FIGS. 1 and 2.

The waveform diagram of FIG. 8 shows the fall-down waveform of the control signal DS and the fall-down waveform of the control signal WS, which determine the timing of turning-on of the switching transistor Tr4 and the timing of turning-off of the sampling transistor Tr1, respectively, which define the mobility correction period t. At the timing when the potential of the control signal DS applied to the gate of the switching transistor Tr4 becomes lower than the operating point VDD−|Vtp|, the switching transistor Tr4 is turned on, so that the mobility correction time starts. VDD denotes the voltage applied to the source of the switching transistor Tr4, and Vtp denotes the threshold voltage of the switching transistor Tr4.

The control signal WS is applied to the gate of the sampling transistor Tr1. The fall-down waveform of the control signal WS is as shown in FIG. 8. Specifically, initially the potential thereof sharply drops down from the supply potential Vcc, and then gradually decreases toward the ground potential Vss. When a signal potential Vsig1 applied to the source of the sampling transistor Tr1 is for the white level and hence high, the optimum mobility correction time t1 is short because the gate potential of the sampling transistor Tr1 falls down to the operating point Vsig1+Vtn rapidly. Vsig1 denotes the voltage applied to the source of the sampling transistor Tr1, and Vtn denotes the threshold voltage of the sampling transistor Tr1. When the signal potential is Vsig2 for a gray level, the sampling transistor Tr1 is turned off at the timing when the gate potential is lowered from Vcc to the operating point Vsig2+Vtn. As a result, the optimum correction time t2 corresponding to Vsig2 for the gray level is longer than t1. Furthermore, when the signal potential is Vsig3 for almost the black level, the optimum mobility correction time t3 is further longer compared with the optimum mobility correction time t2 for the gray level.

Figure 9:
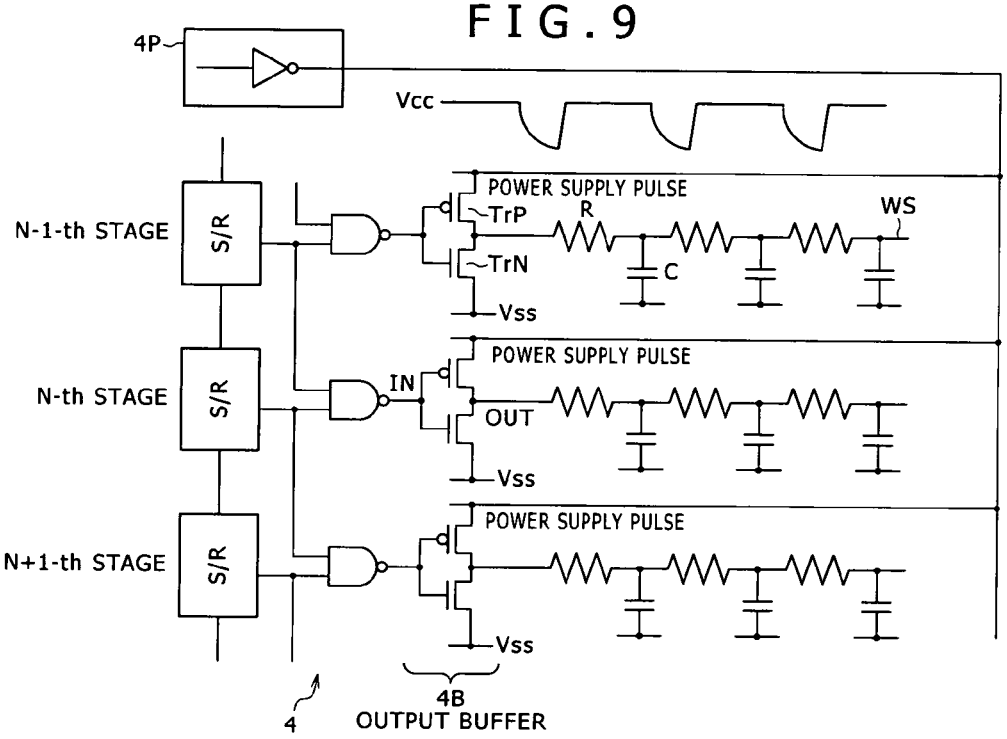
FIG. 9 is a circuit diagram showing a write scanner according to a related-art technique example.

In order to automatically set the optimum mobility correction time for each grayscale, the fall-down waveform of the control signal pulse applied to the scan line WS needs to be shaped into the optimum form like that shown in FIG. 8. To meet this need, a related-art technique example employs a write scanner based on a system to extract a power supply pulse supplied from an external module (pulse generator). This example will be described below with reference to FIG. 9. FIG. 9 schematically shows three stages (N−1-th stage, N-th stage, N+1-th stage) of output parts of the write scanner 4 and three rows (three lines) of the pixel array part 1 connected to these three stages.

The write scanner 4 includes shift registers S/R. The shift register S/R operates in response to a clock signal input from the external and sequentially transfers a start signal input from the external to thereby output a sequential signal on a stage-by-stage basis. A NAND element is connected to each stage of the shift registers S/R. The NAND element performs NAND processing for the sequential signals output from the shift registers S/R at adjacent stages to thereby produce an input signal IN having a rectangular waveform. This signal with a rectangular waveform is input to an output buffer 4B via an inverter. This output buffer 4B operates in response to the input signal IN supplied from the shift register side, and supplies the final control signal WS as an output signal OUT to the corresponding scan line WS in the pixel array part 1.

The output buffer 4B is composed of a pair of switching elements connected in series between the supply potential Vcc and the ground potential Vss. In the present embodiment, this output buffer 4B has an inverter configuration. One of the switching elements is a P-channel transistor TrP (typically a PMOS transistor), and the other is an N-channel transistor TrN (typically an NMOS transistor). Each line on the pixel array part side, connected to a respective one of the output buffers 4B, is represented by resistive components R and capacitive components C as an equivalent circuit.

In the present example, the output buffer 4B extracts a power supply pulse supplied from an external pulse module 4P to a power supply line to thereby form the determinate waveform of the control signal WS. As described above, this output buffer 4B has an inverter configuration: the P-channel transistor TrP and the N-channel transistor TrN are connected in series between the power supply line and the ground potential Vss. When the P-channel transistor TrP of the output buffer is turned on in response to the input signal IN from the shift register S/R side, the output buffer 4B extracts the fall-down waveform of the power supply pulse supplied to the power supply line and supplies the extracted waveform as the determinate waveform of the control signal WS to the pixel array part 1 side. By generating the pulse including the determinate waveform by the external module 4P separately from the output buffer 4B and supplying this pulse to the power supply line of the output buffer 4B in this way, the control signal WS having the desired determinate waveform can be produced. In this case, when the P-channel transistor TrP as the dominant switching element is turned on and the N-channel transistor TrN as the recessive switching element is turned off, the output buffer 4B extracts the fall-down waveform of the power supply pulse supplied from the external and outputs the extracted waveform as the determinate waveform OUT of the control signal WS.

Figure 10:
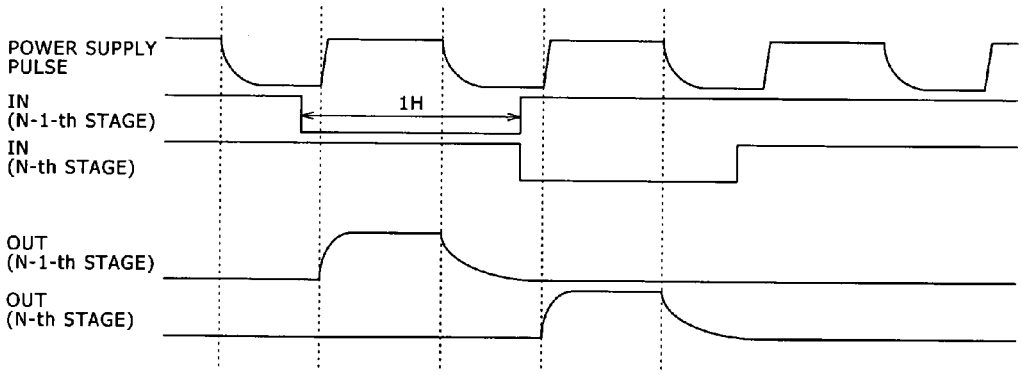
FIG. 10 is a timing chart for explaining the operation of the write scanner shown in FIG. 9.

FIG. 10 is a timing chart for explaining the operation of the write scanner shown in FIG. 9. As shown in FIG. 10, a train of the power supply pulses that oscillate with the 1H-cycle is input to the power supply line of the output buffer in the write scanner from an external module. In synchronization therewith, the input pulse IN is applied to the inverter of the output buffer. The timing chart shows the input pulses IN supplied to the inverters of the N−1-th stage and the N-th stage. Furthermore, the output pulses OUT supplied from the N−1-th stage and the N-th stage are shown along the same time axis as that of the input pulses IN. This output pulse OUT is equivalent to the control signal applied to the scan line WS on the corresponding line.

As is apparent from the timing chart, the output buffer of each stage of the write scanner extracts the power supply pulse in response to the input pulse IN, and supplies the extracted pulse as the output pulse OUT as it is to the corresponding scan line WS. The power supply pulse is supplied from the external module, and the fall-down waveform thereof can be set to the optimum waveform in advance. The write scanner extracts this fall-down waveform as it is and uses the extracted waveform for the control signal pulse.

Figure 11:
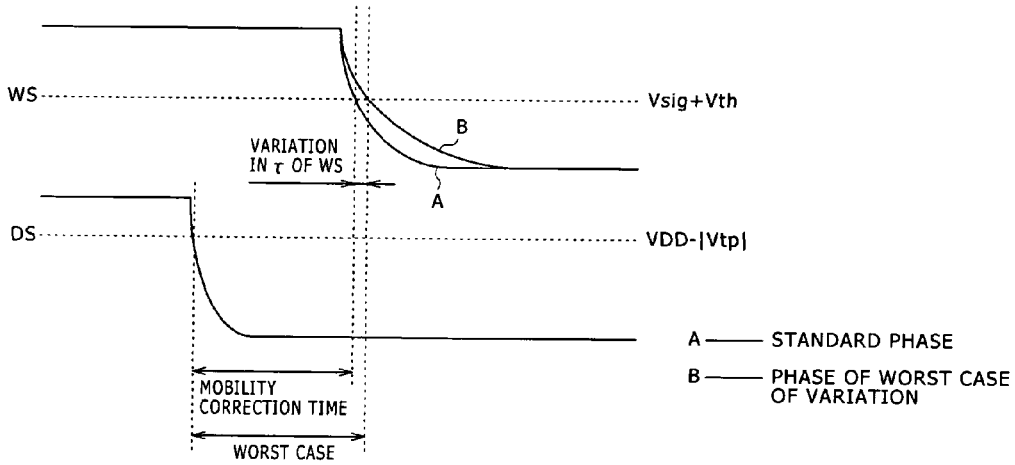
FIG. 11 is a waveform diagram for explaining the operation of the write scanner shown in FIG. 9.

FIG. 11 is a waveform diagram showing the control signal WS produced by the write scanner shown in FIG. 9. The control signal DS output from the drive scanner is also shown in FIG. 11. As shown in FIG. 11, the mobility correction time starts at the timing when the P-channel switching transistor Tr4 is turned on due to the falling-down of the control signal DS, and finishes at the timing when the N-channel sampling transistor Tr1 is turned off due to the falling-down of the control signal WS. The timing of the turning-on of the switching transistor Tr4 is the same as the timing when the potential of the control signal DS becomes lower than VDD−|Vtp|. Vtp denotes the threshold voltage of the P-channel switching transistor Tr4. The timing of the turning-off of the sampling transistor Tr1 is the same as the timing when the potential of the control signal WS becomes lower than Vsig+Vtn. Vtn denotes the threshold voltage of the N-channel sampling transistor Tr1. The signal potential Vsig is applied from the signal line to the source of the sampling transistor Tr1, and the control signal WS is applied from the scan line WS to the gate of the sampling transistor Tr1. The sampling transistor Tr1 is turned off when the gate potential becomes lower than the potential obtained by adding Vtn to the source potential.

The output buffer 4B in the write scanner shown in FIG. 9 according to the related-art technique extracts the power supply pulse via the P-channel transistor TrP when the input signal IN is at the low level. The lower the level of the power supply pulse to be extracted is, the lower the operating voltage Vgs of the P-channel transistor TrP of the output buffer 4B is. When the operating voltage Vgs is lower, the pulse transient of the extracted control signal WS is more susceptible to the influence of variation in the characteristics of the P-channel transistor TrP. In particular, due to the influence of variation in the threshold voltage of the P-channel transistor TrP, variation arises in the transient $\tau$ of the control signal WS. In the waveform diagram of FIG. 11, the fall-down waveform A of the control signal WS indicates the standard phase, whereas the fall-down waveform B indicates the worst case involving a large change of the transient $\tau$. As is apparent from FIG. 11, the mobility correction time in the worst case is longer than that when the fall-down waveform of the control signal WS has the standard phase. In this manner, in the write scanner based on the system to produce the control signal WS by extracting the power supply pulse, the transient of the control signal WS varies from scan line to scan line due to the influence of the manufacturing process, and thus the mobility correction time also varies from scan line to scan line. This variation appears as luminance unevenness (streak) along the horizontal direction on the screen, which spoils the uniformity of the screen.

Furthermore, in the write scanner according to the related-art technique, a slope is positively given to the fall-down waveform of the control signal WS for optimization of the mobility correction time corresponding to the luminance level of the video signal as shown in the waveform diagram of FIG. 8. As shown in FIG. 8, when the video signal is at the level Vsig1 as a comparatively-high level, the optimum mobility correction time t1 is short. In contrast, when the video signal is at the level Vsig3 as a comparatively-low level, the optimum mobility correction time t3 is long. That is, the optimum mobility correction time t becomes longer as the level of the video signal becomes lower, and this characteristic is often incompatible with enhancement in the operating speed of the display panel. Specifically, if the operating speed of a panel is enhanced along with enhancement in the definition and the pixel density of the panel, the horizontal scanning period is shortened. Therefore, the mobility correction operation needs to be completed within the shortened horizontal scanning period. However, it is becoming difficult for the system of the related-art technique to meet this need when the optimum mobility correction time t is long for low luminance, and this is a problem that should be solved.

Furthermore, in the write scanner shown in FIG. 9 according to the related-art technique, the module needs to produce the power supply pulse with a cycle of one horizontal scanning period (1H). In addition, the loads of all stages are connected to the interconnects for supplying the power supply pulse to the pixel array part side, and therefore the interconnect capacitance thereof is very high. Consequently, the power consumption of the external module that supplies the power supply pulse is high. Moreover, stable pulse transient needs to be ensured for the control of the mobility correction time. To meet this need, the capability of the pulse module needs to be enhanced. This results in increase in the module area. In application to a display of mobile apparatus, reduction in the power consumption of the display device is particularly needed. However, it is difficult that the scanner configuration employing the external module shown in FIG. 9 meets this need.

Figure 12:
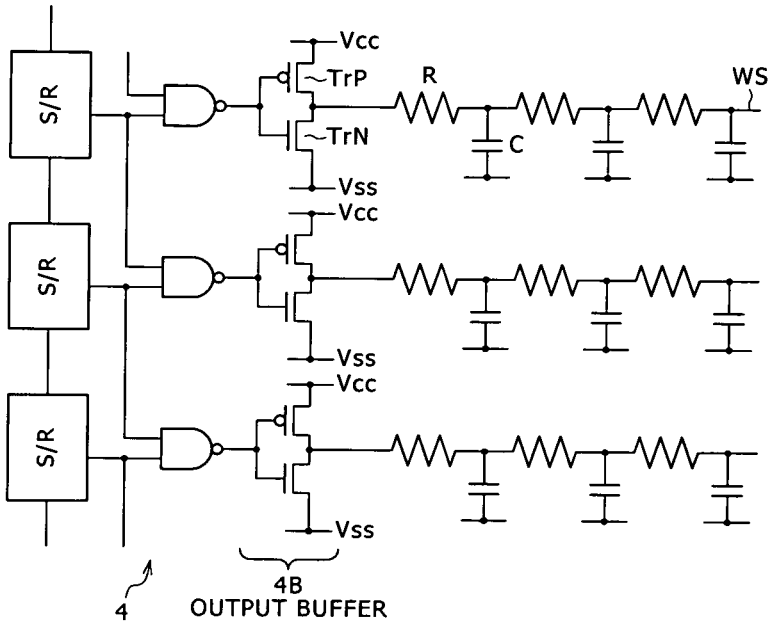
FIG. 12 is a circuit diagram showing the configuration of a write scanner incorporated in the display device according to the embodiment of the present invention.

FIG. 12 is a schematic circuit diagram showing a write scanner for addressing the above-described problems of the write scanner according to the related-art technique. The write scanner shown in FIG. 12 is incorporated in the drive part of the display device shown in FIGS. 1 and 2 according to an embodiment of the present invention. As shown in FIG. 12, the write scanner 4 includes shift registers S/R. The shift register S/R operates in response to a clock signal input from the external and sequentially transfers a start signal input from the external to thereby output a sequential signal on a stage-by-stage basis. A NAND element is connected to each stage of the shift registers S/R. The NAND element performs NAND processing for the sequential signals output from the shift registers S/R at adjacent stages to thereby produce an input signal as the basis of the control signal WS. This input signal is supplied to an output buffer 4B. This output buffer 4B operates in response to the input signal supplied from the shift register S/R side, and supplies the final control signal WS to the corresponding scan line WS in the pixel array part. In FIG. 12, the interconnect resistance of each scan line WS is represented as R, and the capacitance of the pixel connected to each scan line WS is represented as C.

The output buffer 4B is composed of a pair of switching elements connected in series between the supply potential Vcc and the ground potential Vss. In the present example, this output buffer 4B has an inverter configuration. One of the switching elements is a P-channel transistor TrP, and the other is an N-channel transistor TrN. The inverter inverts the input signal supplied from the shift register S/R of the corresponding stage via the NAND element, and outputs the inverted signal as the control signal to the corresponding scan line WS. This write scanner according to an embodiment of the present invention does not employ any external pulse power supply. The input signal supplied from the shift register S/R is inverted and amplified by the output buffer 4B, and the resulting signal is supplied as the control signal to the corresponding scan line WS. The write scanner sequentially transfers the start signal input from the external, to thereby produce the input signal as the basis of the control signal. The waveform of the control signal is basically the same as that of the start signal. This write scanner obtains the control signal by sequentially transferring the start pulse similarly to a typical scanner without using an external pulse power supply. This allows suppression of the power consumption of the write scanner.

As a first feature of the embodiments of the present invention, the write scanner 4 shown in FIG. 12 supplies a control signal including at least double pulses to the scan line WS to thereby define a first correction period, a second correction period, and a correction intermediate period therebetween. Due to this feature, the sampling transistor in each pixel can carry out writing of a correction amount to the holding capacitor in the first correction period, and can accelerate the writing of the correction amount to the holding capacitor in the correction intermediate period. Furthermore, the sampling transistor can settle the writing of the correction amount to the holding capacitor in the second correction period. The acceleration of the writing of the mobility correction amount can shorten the mobility correction time, which allows compatibility with enhancement in the driving speed of the panel. In the correction intermediate period, the sampling transistor automatically adjusts the degree of the acceleration of the writing of the correction amount to the holding capacitor depending on the level of the video signal, and thereby can write the correction amount dependent upon the level of the video signal to the holding capacitor. Specifically, the degree of the acceleration in the case of writing of the video signal for the black level is relatively high compared with the case of writing the video signal for the white level. Thus, even for the video signal for the black level, the mobility correction operation can be completed in a short time unlike the related-art technique example.

As a second feature of the embodiments of the present invention, the write scanner 4 supplies a control signal including at least double pulses having peak levels different from each other to the scan line WS. Due to this feature, the sampling transistor in each pixel is turned on and off in accordance with the peak levels of the double pulses applied to the gate thereof depending on the level of the video signal applied to the source thereof, and thereby can automatically adjust the correction time depending on the level of the video signal. Specifically, the write scanner 4 supplies, to the scan line WS, the control signal WS including double pulses composed of a first pulse and a second pulse whose peak level is lower than that of the first pulse. Due to this signal supply, when the level of the video signal is high (for the white level), the sampling transistor is turned on in response to the first pulse and writes the correction amount to the holding capacitor only during the period of the on-state thereof due to the first pulse. On the other hand, when the level of the video signal is low (for the black level), the sampling transistor is turned on in response both to the first pulse and to the second pulse, and writes the correction amount to the holding capacitor during the periods of the on-state thereof due to the first and second pulses. In this way, switching control of the mobility correction time can be automatically carried out depending on the luminance level of the video signal. Depending on the case, the write scanner 4 sets the pulse widths of the respective pulses included in the control signal WS shorter than the transient times of the pulse waveforms of the pulses, to thereby set the peak levels of the respective pulses.

As is apparent from the above description, the mobility correction operation is divided into plural times of operation in the embodiment of the present invention. Current flows also in the period between the divided correction times, so that accelerated mobility correction is carried out. Through synthesis of the correction times corresponding to the respective operating points, the mobility correction time for each grayscale is determined. The write scanner does not have a configuration to extract a power supply pulse but sequentially transfers a start pulse originally including double pulses to thereby supply a control signal including the double pulses to the respective scan lines and carry out the desired mobility correction operation in a dividing manner.

Figure 13:
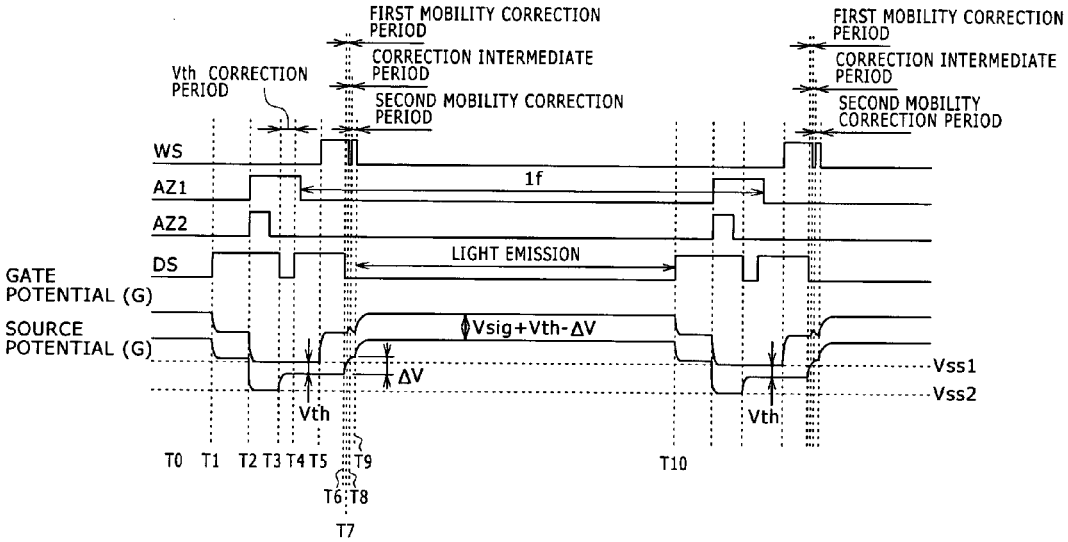
FIG. 13 is a timing chart showing a first embodiment of the present invention.

FIG. 13 is a schematic timing chart showing a display device according to a first embodiment of the present invention. The timing chart of FIG. 13 employs the same representation manner as that of the timing chart of FIG. 4 relating to the reference example, for easy understanding. This first embodiment corresponds to the first mode of the present invention.

At a timing T0, which is prior to the start of the description-subject field, all of the control signals WS, AZ1, AZ2, and DS are at the low level. Therefore, the N-channel transistors Tr1, Tr2, and Tr3 are in the off-state whereas only the P-channel transistor Tr4 is in the on-state. Thus, the drive transistor Trd is coupled to the power supply VDD via the transistor Tr4 in the on-state, and therefore supplies the output current Ids to the light-emitting element EL depending on the predetermined input voltage Vgs. Consequently, the light-emitting element EL emits light at the timing T0. The input voltage Vgs applied at this time to the drive transistor Trd is represented as the potential difference between the gate potential (G) and the source potential (S).

At a timing T1, which is the start of the description-subject field, the control signal DS is switched from the low level to the high level. This turns off the switching transistor Tr4, which isolates the drive transistor Trd from the power supply VDD. Thus, the light emission is stopped and a non-light-emission period starts. That is, at the timing T1, all of the transistors Tr1 to Tr4 enter the off-state.

Subsequently, at a timing T2, the control signals AZ1 and AZ2 are switched to the high level, which turns on the switching transistors Tr2 and Tr3. As a result, the gate G of the drive transistor Trd is coupled to the reference potential Vss1, and the source S thereof is coupled to the reference potential Vss2. The potentials Vss1 and Vss2 satisfy the relationship Vss1−Vss2>Vth. Therefore, through ensuring of the relationship Vss1−Vss2=Vgs>Vth, preparation for the Vth correction from a timing T3 is carried out. That is, the period T2 to T3 corresponds to the reset period for the drive transistor Trd. Furthermore, the relationship VthEL>Vss2 is designed, in which VthEL denotes the threshold voltage of the light-emitting element EL. Due to this relationship, negative bias is applied to the light-emitting element EL, and therefore the light-emitting element EL is in the so-called reverse-bias state. This reverse-bias state is necessary to normally carry out Vth correction operation and mobility correction operation later.

At the timing T3, the control signal AZ2 is switched to the low level, and thereupon the control signal DS is also switched to the low level. Thus, the transistor Tr3 is turned off while the transistor Tr4 is turned on. As a result, the drain current Ids flows toward the holding capacitor Cs, so that the Vth correction operation is started. During the current flow, the potential of the gate G of the drive transistor Trd is kept at Vss1. The current Ids flows until the drive transistor Trd is cut off. At the timing of the cutting-off of the drive transistor Trd, the source potential (S) of the drive transistor Trd is Vss1−Vth. At a timing T4, which is after the cutting-off of the drain current, the control signal DS is returned to the high level again to thereby turn off the switching transistor Tr4. In addition, the control signal AZ1 is returned to the low level to thereby turn off the switching transistor Tr2. As a result, Vth is held and fixed in the holding capacitor Cs. In this manner, the threshold voltage Vth of the drive transistor Trd is detected in the period T3 to T4. In the present specification, the detection period T3 to T4 is referred to as a Vth correction period.

After the Vth correction is thus carried out, the control signal WS is switched to the high level at a timing T5. Thus, the sampling transistor Tr1 is tuned on to thereby write the video signal Vsig to the holding capacitor Cs. The capacitance of the holding capacitor Cs is sufficiently lower than that of the equivalent capacitor Coled of the light-emitting element EL. Consequently, most of the video signal Vsig is written to the holding capacitor Cs. To be exact, the potential difference Vsig−Vss1 is written to the holding capacitor Cs. Therefore, the voltage Vgs between the gate G and the source S of the drive transistor Trd becomes the voltage (Vsig−Vss1+Vth), which results from the addition of the sampled voltage Vsig−Vss1 to the voltage Vth detected and held in advance. If the relationship Vss1=0 V is employed in order to simplify the following description, the gate-source voltage Vgs is Vsig+Vth as shown in the timing chart of FIG. 13. This sampling of the video signal Vsig is carried out until a timing T7, at which the control signal WS is returned to the low level. That is, the period T5 to T7 corresponds to the sampling period (video signal writing period).

At a timing T6, which is prior to the timing T7 as the end timing of the sampling period, the control signal DS is switched to the low level, which turns on the switching transistor Tr4. This couples the drain of the drive transistor Trd to the power supply VDD, so that current is supplied to the pixel. During the period T6 to T7, in which the sampling transistor Tr1 is still in the on-state and the switching transistor Tr4 enters the on-state, first mobility correction for the drive transistor Trd is carried out. In this first mobility correction period T6 to T7, the drain current Ids flows through the drive transistor Trd in the state in which the gate G of the drive transistor Trd is fixed at the level of the video signal Vsig. If the relationship Vss1−Vth<Vthe1 is designed in advance, the light-emitting element EL is kept at the reverse-bias state and therefore exhibits not a diode characteristic but a simple capacitive characteristic. Consequently, the current Ids, which flows through the drive transistor Trd, is written to the capacitor C=Cs+Coled, resulting from coupling between the holding capacitor Cs and the equivalent capacitor Coled of the light-emitting element EL. This raises the source potential (S) of the drive transistor Trd. This potential rise is eventually equivalent to subtraction from the gate-source voltage Vgs held in the holding capacitor Cs, and thus is equivalent to negative feedback. By thus carrying out the negative feedback of the output current Ids of the drive transistor Trd to the input voltage Vgs of the same drive transistor Trd, correction for the mobility μ is allowed.

At the timing T7, the control signal WS is switched to the low level, which turns off the sampling transistor Tr1. The correction intermediate period starts and continues until the control signal WS is switched to the high level again at a timing T8. In this correction intermediate period T7 to T8, the gate G of the drive transistor Trd is isolated from the signal line SL. Because the application of the video signal Vsig to the gate is stopped, the gate potential (G) of the drive transistor Trd is permitted to increase, and therefore rises up together with the source potential (S). This bootstrap operation in the correction intermediate period T7 to T8 allows accelerated mobility correction operation. Specifically, in this correction intermediate period T7 to T8, the source potential (S) of the drive transistor Trd increases as with in the first mobility correction period, and the degree of the increase is enhanced compared with that in the first mobility correction period because the increase in the gate potential is not suppressed in the correction intermediate period T7 to T8.

At the timing T8, the second control signal pulse is applied to the scan line WS, and thus the sampling transistor Tr1 is turned on again. The period until the second pulse is stopped at a timing T9 serves as a second mobility correction period T8 to T9. Upon the start of the second mobility correction period, the sampling transistor Tr1 is turned on again, and thus the potential of the gate G of the drive transistor Trd is suppressed to the level of the video signal Vsig. On the other hand, current continues to flow to the source S of the drive transistor Trd due to the mobility correction operation, and therefore the increase in the source potential (S) continues. However, the increase speed thereof is not high unlike in the correction intermediate period T7 to T8, because the gate potential (G) is suppressed to Vsig.

As a result of the elapse of the first mobility correction period T6 to T7, the correction intermediate period T7 to T8, and the second mobility correction period T8 to T9, the increase amount of the source potential (S) of the drive transistor Trd reaches ΔV. This ΔV is the synthetic mobility correction amount.

At the timing T9, the control signal WS is switched to the low level, which turns off the sampling transistor Tr1. As a result, the gate G of the drive transistor Trd is isolated from the signal line SL. Because the application of the video signal Vsig is stopped, the gate potential (G) of the drive transistor Trd is permitted to increase, and therefore rises up together with the source potential (S). During this potential rise, the gate-source voltage Vgs held in the holding capacitor Cs is kept at the value (Vsig−ΔV+Vth). The increase of the source potential (S) eliminates the reverse-bias state of the light-emitting element EL in due course. Therefore, the light-emitting element EL starts actual light emission due to the flowing of the output current Ids thereto.

Finally, at a timing T10, the control signal DS is switched to the high level and thus the switching transistor Tr4 is turned off. This isolates the pixel from the supply potential VDD, so that the light emission and the description-subject field finish. Simultaneously the next field starts, so that the Vth correction operation, the divided mobility correction operation, and the light-emission operation will be repeated again.

Figure 14:
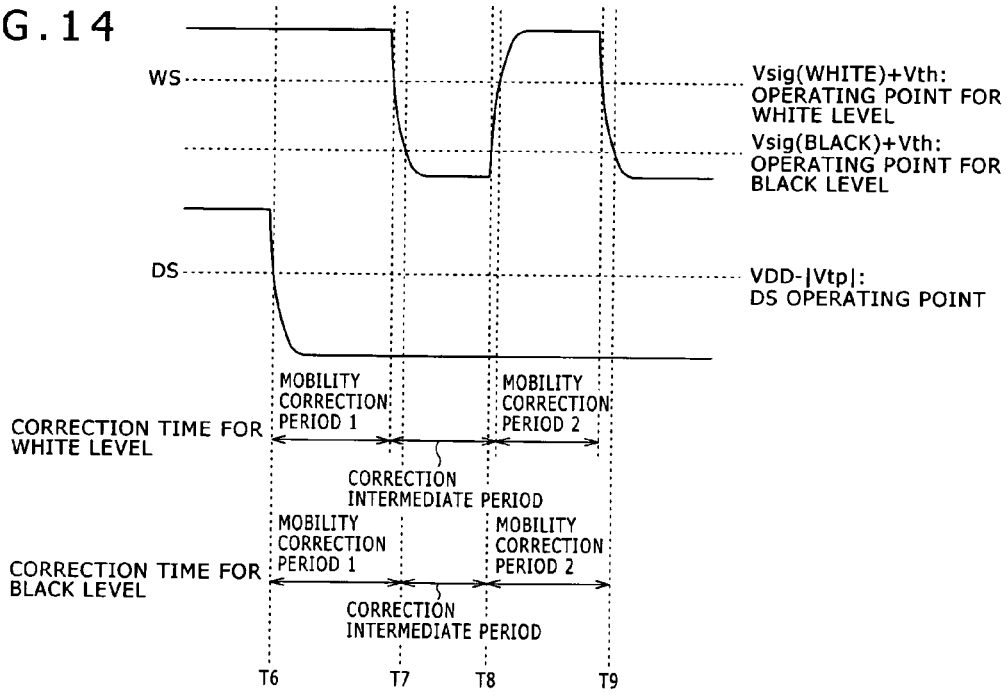
FIG. 14 is a waveform diagram for explaining the operation of the first embodiment.

FIG. 14 is a diagram showing the waveforms of the control signals WS and DS, particularly in the period from the timing T6 to the timing T9. As described above, the control signal WS is applied to the gate of the sampling transistor. In FIG. 14, both the operating point of the sampling transistor for the white level and that for the black level are shown. Every time the potential of the control signal WS crosses this operating point, the state of the sampling transistor is switched between the on-state and the off-state. The control signal DS is applied to the gate of the switching transistor Tr4. The operating point of this switching transistor Tr4 is also shown. In response to the crossing of the potential of the control signal DS across this operating point, the state of the switching transistor Tr4 is switched between the on-state and the off-state. In the present example, the control signal WS has an almost rectangular waveform and both the fall-down edge and the rise-up edge thereof are sharp. Therefore, the difference in the operating point between the white level and the black level does not cause large influence.

Initially at the timing T6, the switching transistor Tr4 is turned on with the sampling transistor Tr1 kept at the on-state, so that mobility correction period 1 starts. At the timing T7, the sampling transistor is turned off temporarily and thus mobility correction period 1 ends. This mobility correction period 1 is set shorter compared with in the reference example shown in FIG. 4.

Also after the timing T7 as the end timing of mobility correction period 1, the switching transistor Tr4 is in the on-state. Therefore, also in the correction intermediate period, current flows from the supply potential VDD to the drive transistor, and thus the source potential of the drive transistor rises up. At this time, the gate of the drive transistor is in the high-impedance state, and therefore the gate potential also rises up. Because the output current Ids supplied from the drive transistor is proportional to the mobility μ, these potential rises are proportional to the mobility. In other words, accelerated mobility correction is carried out in the correction intermediate period.

At the timing T8, the sampling transistor is turned on again, and thus mobility correction period 2 starts. At this time, the signal potential is at Vsig as with in mobility correction period 1, and therefore the gate potential of the drive transistor is set to Vsig as with in mobility correction period 1. On the other hand, in the correction intermediate period, both the gate potential and the source potential rise up due to the bootstrap effect as described above. At the timing T8, only the gate potential is returned to Vsig, whereas the source potential is not returned but continues to rise up. Thus, the accelerated mobility correction period in the correction intermediate period finishes at the timing when the gate potential of the drive transistor is returned to Vsig at the timing T8. The mobility correction has not yet been completed in the correction intermediate period. Therefore, the output current Ids supplied from the drive transistor in this correction intermediate period is larger than the current supplied after the completion of the correction. The ratio of the current supplied in the correction intermediate period to the current supplied after the completion of the correction is relatively higher for a low grayscale compared with the ratio for a high grayscale. Thus, the lower the grayscale is, the higher the degree of the acceleration of the mobility correction in the correction intermediate period is.

Finally, at the timing T9, the sampling transistor is turned off to thereby finish mobility correction period 2. Through the above-described operation, the mobility correction amount for each grayscale is determined by the normal correction amount in the first correction period+the normal correction amount in the second correction period+the accelerated correction amount in the correction intermediate period. As described above, the degree of the acceleration of the correction in the correction intermediate period is higher when the grayscale is lower. Thus, even with the same time design, the optimum correction time corresponding to the grayscale can be obtained equivalently. Specifically, the adaptive control of the mobility correction period corresponding to the grayscale is equivalently carried out by automatically adjusting the degree of the acceleration of the mobility correction depending on the grayscale, instead of adjusting the mobility correction time depending on the grayscale. In the embodiment of the present invention, the adaptive correction of the mobility dependent upon the grayscale can be carried out by using only the output pulse from the scanner, without using an external pulse power supply. This feature eliminates the problem of variation in the correction time, involved in the extraction of the power supply pulse, and thus can achieve the image quality of high uniformity with low power consumption.

Figure 15:
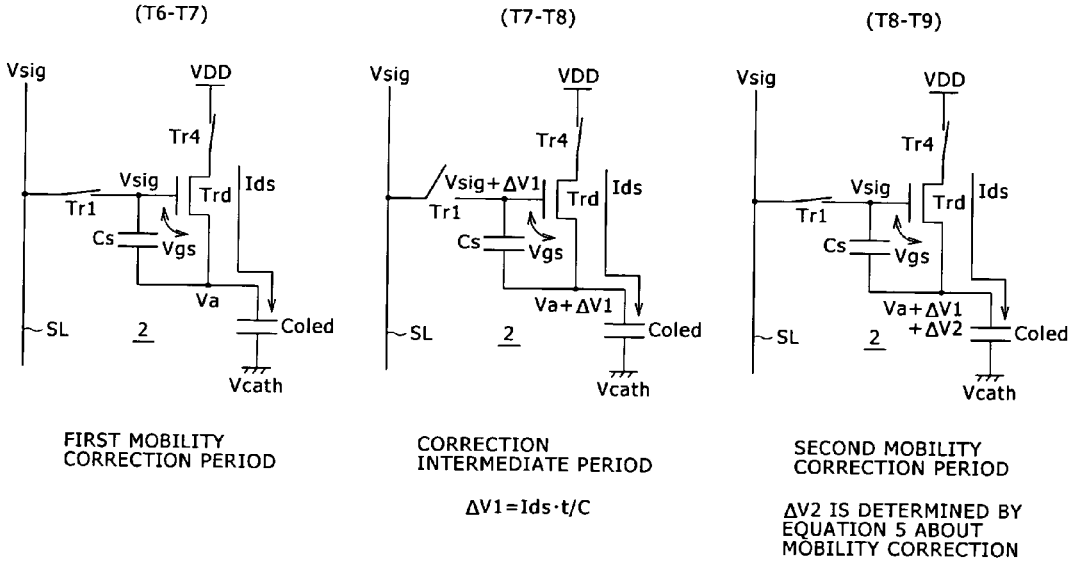
FIG. 15 is a circuit diagram for explaining the operation of the first embodiment.

FIG. 15 is a schematic diagram showing the divided mobility correction operation in a pixel. Initially, in the first mobility correction period (T6 to T7), both the sampling transistor Tr1 and the switching transistor Tr4 in each pixel 2 are in the on-state. Thus, Vsig is applied to the gate of the drive transistor Trd, and the supply voltage VDD is applied to the drain thereof. Therefore, the drain current Ids dependent upon Vsig flows through the drive transistor Trd. However, the light-emitting element is in the reverse-bias state, and thus the current Ids is used exclusively for charging of the holding capacitor Cs and the capacitor Coled of the light emitting element. Due to the flowing of the drive current Ids to the source of the drive transistor Trd in this first mobility correction period (T6 to T7), the source potential rises up to Va.

Subsequently, upon the start of the correction intermediate period (T7 to T8), the sampling transistor Tr1 is turned off, and thus the gate of the drive transistor Trd is isolated from the signal line SL so as to enter the floating state. On the other hand, the switching transistor Tr4 is continuously kept at the on-state and thus the drain current Ids flows through the drive transistor Trd. This raises the source potential from Va by ΔV1. The gate potential also rises up from Vsig by ΔV1 due to the bootstrap operation. This potential rise amount ΔV1 is represented as Ids·t/C. t denotes the length of the correction intermediate period, and C denotes the synthetic capacitance between Cs and Coled. As shown in the above-described Equation 1, Ids is proportional to the mobility μ. Therefore, the correction amount ΔV1 in the correction intermediate period is proportional to the mobility μ, and consequently mobility correction is carried out in the correction intermediate period. In addition, in this correction intermediate period, the speed of the increase in the source potential is high because the gate potential is not suppressed, and therefore accelerated mobility correction is carried out.

At the start of the second mobility correction period (T8 to T9), the sampling transistor Tr1 is turned on again, so that the gate potential of the drive transistor Trd is returned to Vsig. The source potential further rises up from Va+ΔV1 by ΔV2. This correction amount ΔV2 is equivalent to the potential addition in the second mobility correction period (T8 to T9). The correction amount ΔV2 is determined by Equation 5 about the mobility correction.

Figure 16:
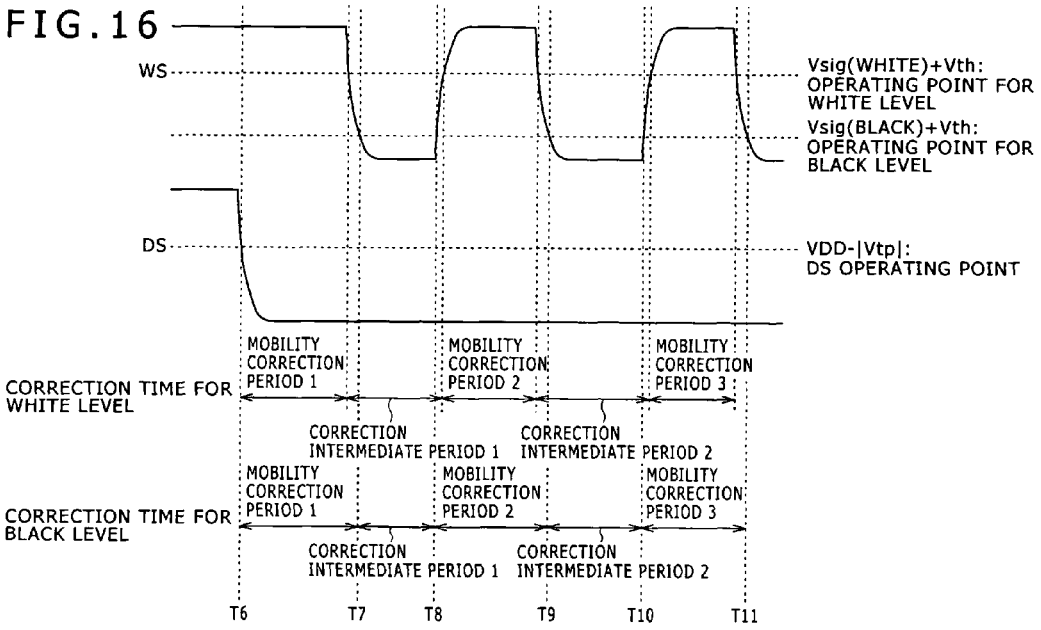
FIG. 16 is a waveform diagram showing a modification example of the first embodiment.

FIG. 16 is a waveform diagram showing a modification example of the first embodiment. FIG. 16 employs the same representation manner as that of the waveform diagram of FIG. 14 for the first embodiment for easy understanding. In the first embodiment shown in FIG. 14, the divided mobility correction is carried out in such a way that the mobility correction period is divided into two periods. On the other hand, in the present modification example, the divided mobility correction is carried out in such a way that the mobility correction period is divided into three periods. The period T6 to T7 serves as mobility correction period 1, the period T7 to T8 serves as Correction intermediate period 1, the period T8 to T9 serves as mobility correction period 2, the period T9 to T10 serves as Correction intermediate period 2, and the period T10 to T11 serves as mobility correction period 3. In this way, in the first mode of the present invention, mobility correction operation is divided into plural times of operation in the state in which the supply voltage VDD is supplied to the drain of the drive transistor. Due to this feature, accelerated mobility correction operation can be carried out in the middle of the correction period, and the optimum correction time can be achieved for each grayscale without using an external power supply pulse. Thus, high uniformity can be achieved for all of the grayscales, and the power consumption of the panel module can be reduced.

Figure 17:
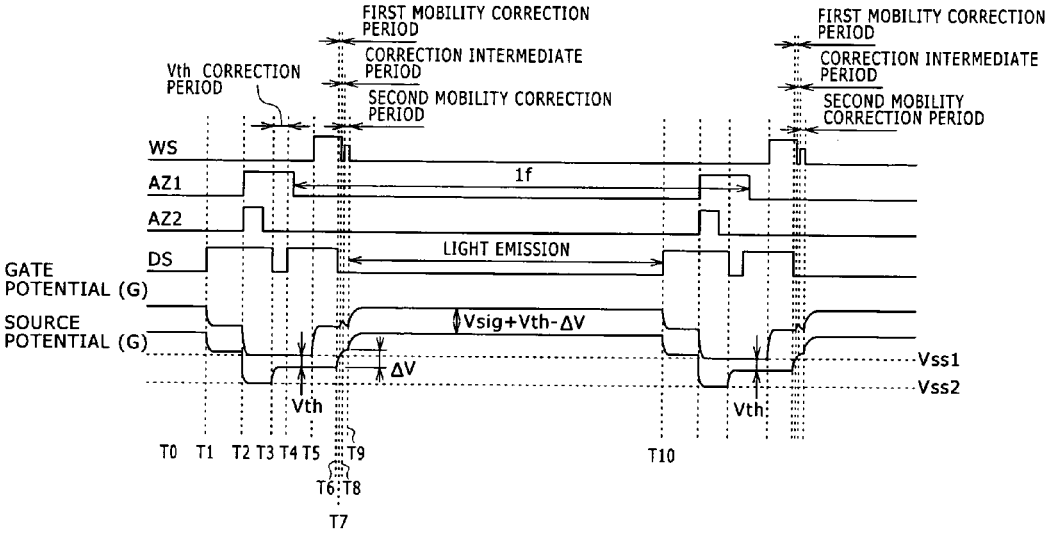
FIG. 17 is a timing chart showing a display device according to a second embodiment of the present invention.

FIG. 17 is a timing chart showing the operation of a display device according to a second embodiment of the present invention. This second embodiment corresponds to the second mode of the present invention. The timing chart of FIG. 17 employs the same representation manner as that of the timing chart of FIG. 13 for the first embodiment for easy understanding. Also in the present embodiment, the mobility correction period is divided into two periods similarly to the first embodiment. Specifically, the mobility correction period is divided into a first mobility correction period T6 to T7 and a second mobility correction period T8 to T9. Furthermore, a correction intermediate period T7 to T8 exists between these mobility correction periods. The control signal WS includes double pulses, and these pulses define the first mobility correction period and the second mobility correction period, respectively. However, the second embodiment is different from the first embodiment, in that the peak levels of the double pulses are different from each other. The sampling transistor is turned on and off in accordance with the peak levels of the double pulses applied to the gate thereof depending on the level of the video signal applied to the source thereof, and thereby automatically adjusts the correction time depending on the level of the video signal. Specifically, the write scanner supplies, to the scan line, the control signal WS including double pulses composed of a first pulse and a second pulse whose peak level is lower than that of the first pulse. Due to this feature, when the level of the video signal is high (for the white level), the sampling transistor is turned on in response to the first pulse and writes the mobility correction amount to the holding capacitor only during the first mobility correction period T6 to T7. On the other hand, when the level of the video signal is low (for a gray level or the black level), the sampling transistor is turned on in response both to the first pulse and to the second pulse and writes the mobility correction amount to the holding capacitor during the first mobility correction period T6 to T7 and the second mobility correction period T8 to T9.

Figure 18:
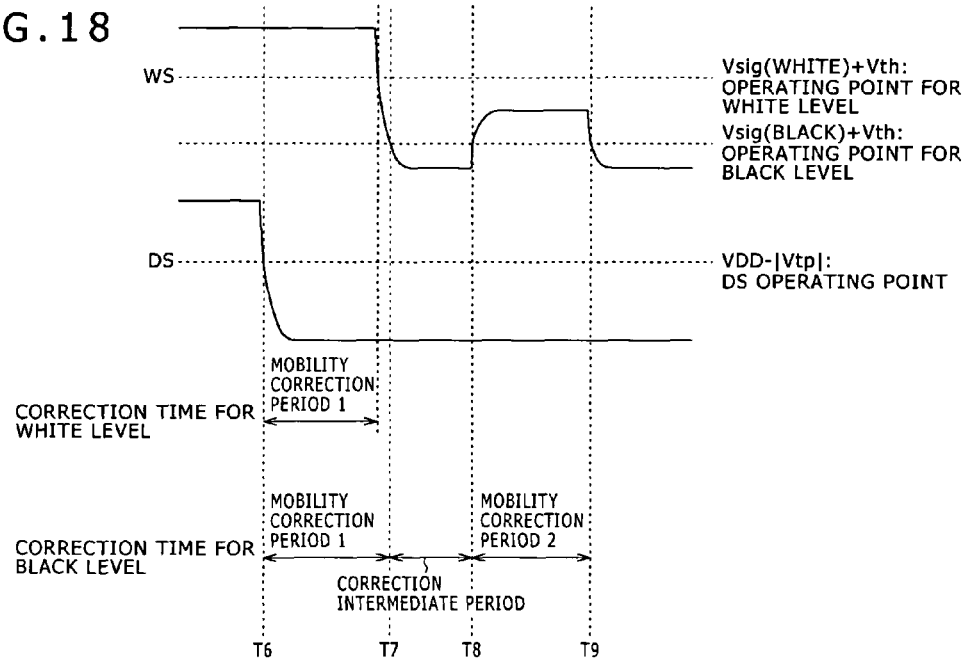
FIG. 18 is a waveform diagram for explaining the operation of the second embodiment.

FIG. 18 is a waveform diagram of the control signals WS and DS in the second embodiment. In particular, FIG. 18 shows the waveforms in the period from the timing T6 to the timing T9. The waveform diagram of FIG. 18 employs the same representation manner as that of the waveform diagram of FIG. 14 for the first embodiment for easy understanding. The difference between FIGS. 14 and 18 is that, in FIG. 18, the peak level of the second pulse of the double pulses included in the control signal WS is set lower than that of the first pulse. The peak level of the second pulse exists between the operating point for the white level and the operating point for the black level. In contrast, the peak level of the first pulse exists above the operating point for the white level.

When the video signal has the potential for the white level, the switching transistor Tr4 is turned on at the timing T6 and thus mobility correction period 1 starts. This mobility correction period 1 continues until the sampling transistor Tr1 is turned off at the timing T7. Thereafter, the control signal WS rises up again at the timing T8. However, the peak level thereof does not reach the operating point for the white level. Therefore, the sampling transistor is not turned on but the operation sequence moves to the light-emission period directly. In this manner, when the video signal has the potential for the white level, the mobility correction operation is carried out only in the first mobility correction period (T6 to T7). The optimum mobility correction time for the white level is short as described above, and therefore variation in the mobility can be sufficiently corrected by one time of mobility correction operation.

On the other hand, when the video signal has the potential for a gray level or the black level, the sampling transistor enters the on-state in response to the first pulse included in the control signal, so that the first mobility correction operation is carried out in mobility correction period 1 from the timing T6 to the timing T7. Subsequently, the sampling transistor is turned on again in response to the second pulse included in the control signal WS, so that the second mobility correction operation is carried out in mobility correction period 2 from the timing T8 to the timing T9. The peak level of the second pulse is set lower than the operating point for the white level but set higher than the operating point for the black level. Therefore, the sampling transistor enters the on-state in response to the second pulse when the video signal has the potential for a gray level or the black level. Furthermore, in the correction intermediate period T7 to T8 between the first mobility correction period T6 to T7 and the second mobility correction period T8 to T9, accelerated mobility correction operation is carried out similarly to the first embodiment. However, the present embodiment is different from the first embodiment, in that the mobility correction period is divided into two periods and the accelerated correction operation is carried out in the correction intermediate period only when the video signal has the potential for a gray level or the black level.

As is apparent from the above description, in the second embodiment, only the first mobility correction period exists as the mobility correction period when the video signal has the potential for the white level, and thus the same mobility correction operation as that in the related art is carried out. In the case of a gray level or the black level, for which the sampling transistor is turned on in response not only to the first pulse but also to the second pulse, the total mobility correction amount $\Delta V$ is equal to the normal correction amount in the first mobility correction period+the accelerated correction amount in the correction intermediate period+the normal correction amount in the second mobility correction period. Due to this configuration, adaptive control can be automatically carried out by the internal pulse for the correction operation for the white level, for which the correction time is short, and for the correction operation for a gray level or the black level, for which the correction time is comparatively long.

Figure 19A:
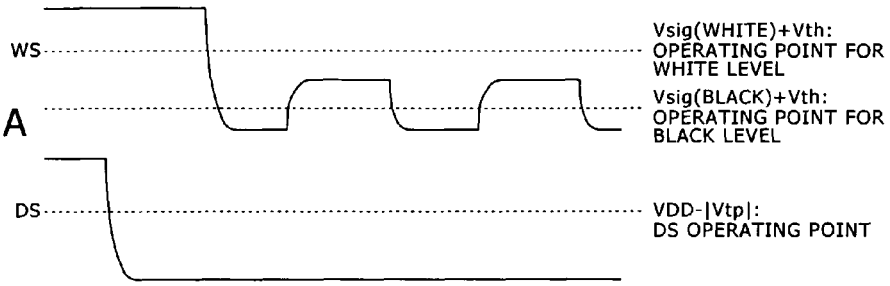
FIGS. 19A and 19B are waveform diagrams showing a modification example of the second embodiment.
Figure 19B:
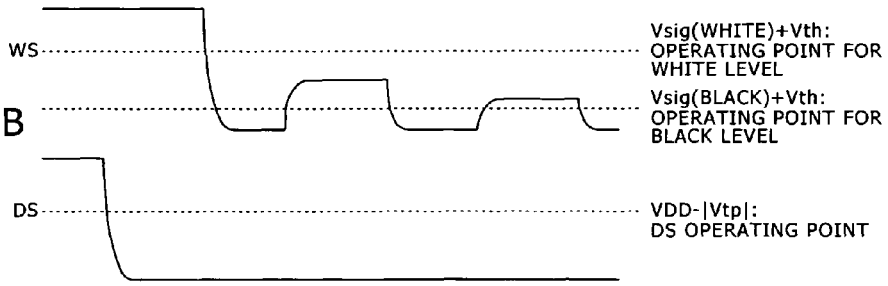

FIGS. 19A and 19B are waveform diagrams each showing modification example of the second embodiment shown in FIG. 18. In a first modification example shown in FIG. 19A, the control signal WS includes triple pulses, and correction operation is carried out in such a way that the mobility correction time is divided into three periods. The peak level of the second pulse and the third pulse is set lower than that of the first pulse, and exists between the operating point for the white level and the operating point for the black level. In the present modification example, the mobility correction operation is carried out only one time for the white level, whereas the mobility correction operation is carried out three times for a gray level and the black level.

FIG. 19B shows a second modification example. The second modification example is different from the first modification example shown in FIG. 19A, in that the peak levels of the second pulse and the third pulse are different from each other. In this case, the mobility correction operation is carried out only one time when the video signal has the potential for the white level. For a gray level, the mobility correction period is carried out two times in response to the first pulse and the second pulse. For the black level, the mobility correction operation is carried out three times in response to the first to third pulses. By increasing the number of pulses and varying the levels of the pulses in this manner, the mobility correction operation corresponding to the grayscale can be carried out more accurately.

Figure 20A:
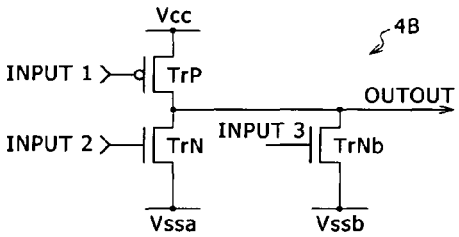
FIGS. 20A and 20B are a schematic diagram and a timing chart, respectively, showing a write scanner according to the second embodiment.
Figure 20B:
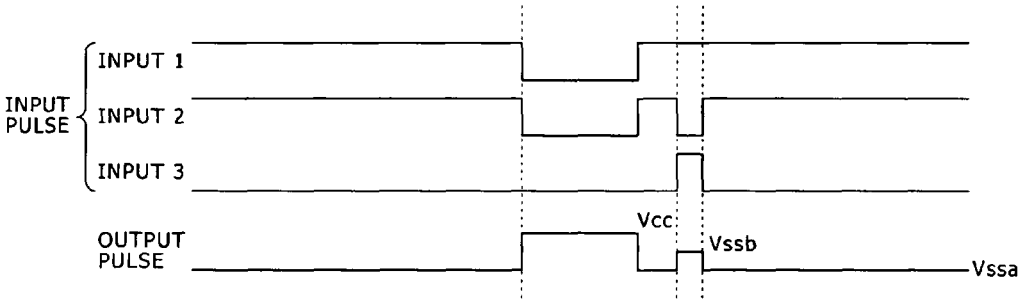

FIGS. 20A and 20B are schematic diagrams showing a configuration example of a write scanner according to the second embodiment of the present invention. FIG. 20A shows an output buffer 4B in the write scanner particularly. As shown in FIG. 20A, the output buffer 4B is composed of one P-channel transistor TrP and two N-channel transistors TrN and TrNb. The pair of transistors TrP and TrN are connected in series between a supply potential Vcc and a ground potential Vssa, and form an inverter. Input pulse 1 is supplied from a shift register to the gate of the P-channel transistor TrP. Input pulse 2 is supplied from the shift register to the gate of the N-channel transistor TrN. The connecting node between the transistors TrP and TrN serves as an output terminal. The N-channel transistor TrNb is connected between the output terminal and a ground potential Vssb. Input pulse 3 is supplied from the shift register to the gate thereof.

FIG. 20B is a timing chart for explaining the operation of the output buffer 4B shown in FIG. 20A. In this timing chart, Input pulses 1, 2, and 3 supplied from the shift register side and the output pulse supplied as the control signal to the scan line are shown along the same time axis. As shown in this timing chart, the output pulse whose peak level is Vcc is supplied when both Input pulses 1 and 2 are at the low level. Subsequently, when Input pulse 2 is at the low level and Input pulse 3 is at the high level, the second pulse whose peak level is Vssb is output. In this way, the output buffer 4B supplies the control signal including the double pulses to the corresponding scan line. Of the double pulses, the first pulse has a peak level of Vcc, and the next pulse has a peak level of Vssb. The level Vssb is set lower than Vcc. In this manner, the write scanner according to the present embodiment can produce the double pulses internally, and does not need to receive supply of a power supply pulse from an external pulse power supply particularly.

Figure 21A:
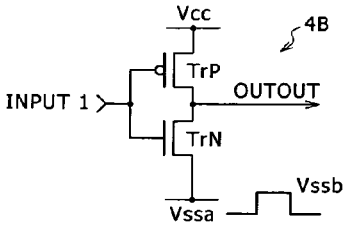
FIGS. 21A and 21B are a schematic diagram and a timing chart, respectively, showing another example of the write scanner according to the second embodiment.
Figure 21B:
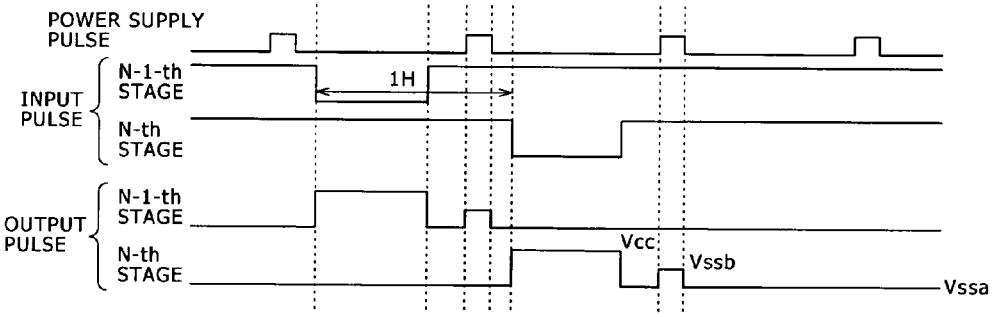

FIGS. 21A and 21B are schematic diagrams showing another example of the write scanner according to the second embodiment. The diagrams of FIGS. 21A and 21B employ the same representation manner as that for the write scanner shown in FIGS. 20A and 20B for easy understanding. As shown in FIG. 21A, the output buffer 4B in this write scanner has a normal inverter configuration and is composed of a P-channel transistor TrP and an N-channel transistor TrN connected in series to each other. The gates of the pair of transistors TrP and TrN are connected to each other and receive supply of an input pulse from a shift register. The connecting node between the transistors TrP and TrN serves as an output terminal and is connected to the corresponding scan line WS. The difference from the example of FIGS. 20A and 20B is that a power supply pulse is supplied from an external pulse power supply to the ground line of the inverter. The level of the power supply pulse is switched between a lower level Vssa and a higher level Vssb.

FIG. 21B is a timing chart for explaining the operation of the output buffer 4B in the write scanner shown in FIG. 21A. In this timing chart, the input pulses and the output pulses of the N−1-th stage and the N-th stage are shown. Furthermore, the waveform of the power supply pulse is also shown in such a way that the phase of the power supply pulse is aligned with the phases of the input and output pulses. As shown in FIG. 21B, the power supply pulse includes pulses that have the 1H cycle and a peak level of Vssb. For e.g. the N-th stage, when the input pulse is at the low level, the inverter of the output buffer 4B inverts the input pulse so as to output the first output pulse whose peak level is Vcc. Thereafter, the input pulse returns to the high level and thus the N-channel transistor TrN enters the on-state, so that the N-channel transistor TrN extracts one power supply pulse so as to output it directly as the second pulse whose peak level is Vssb to the output terminal. The peak level Vssb is set lower than Vcc. In the present example, the power supply pulse is supplied from the external in order to form the double control signal pulses having different peak levels, unlike the above-described example shown in FIGS. 20A and 20B.

Figure 22:
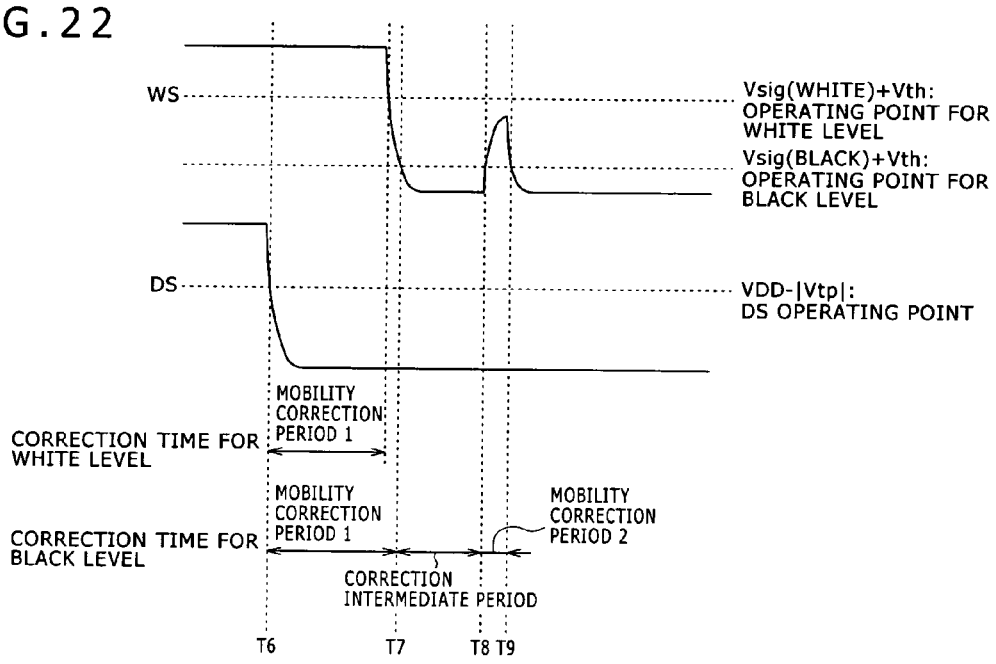
FIG. 22 is a waveform diagram showing another modification example of the second embodiment.

FIG. 22 is a waveform diagram showing a third modification example of the display device according to the second embodiment of the present invention. The waveform diagram of FIG. 22 employs the same representation manner as that of the waveform diagram of FIG. 18 for the second embodiment for easy understanding. Also in the present modification example, the mobility correction period is divided into a first mobility correction period T6 to T7, a second mobility correction period T8 to T9, and a correction intermediate period T7 to T8 between these mobility correction periods. The first peak of the control signal WS, which defines the first mobility correction period T6 to T7, and the second peak, which defines the second mobility correction period T8 to T9, are set to different levels. As a feature of the present modification example, the peak level of the second pulse is designed based on the pulse width of the second pulse (i.e. the second mobility correction period T8 to T9) as a parameter. Specifically, the peak level of the pulse is designed by setting the pulse width shorter than the transient time $\tau$ of the pulse waveform. As shown in FIG. 22, both the rise-up edge and the fall-down edge of the pulse waveform of the control signal WS involve transient, and therefore distortion arises in the pulse waveform. By causing the pulse to fall down before the level of the pulse completely reaches Vcc after the rising-up of the pulse, the peak level of the pulse can be freely varied. As the pulse width is extended, the peak level shifts toward the upper level. If the pulse width surpasses the transient time, the peak level reaches Vcc. Adjusting the width of the second pulse makes it possible to set the peak level of the second pulse to a predetermined level between the operating point for the white level and the operating point for the black level.

Figure 23:
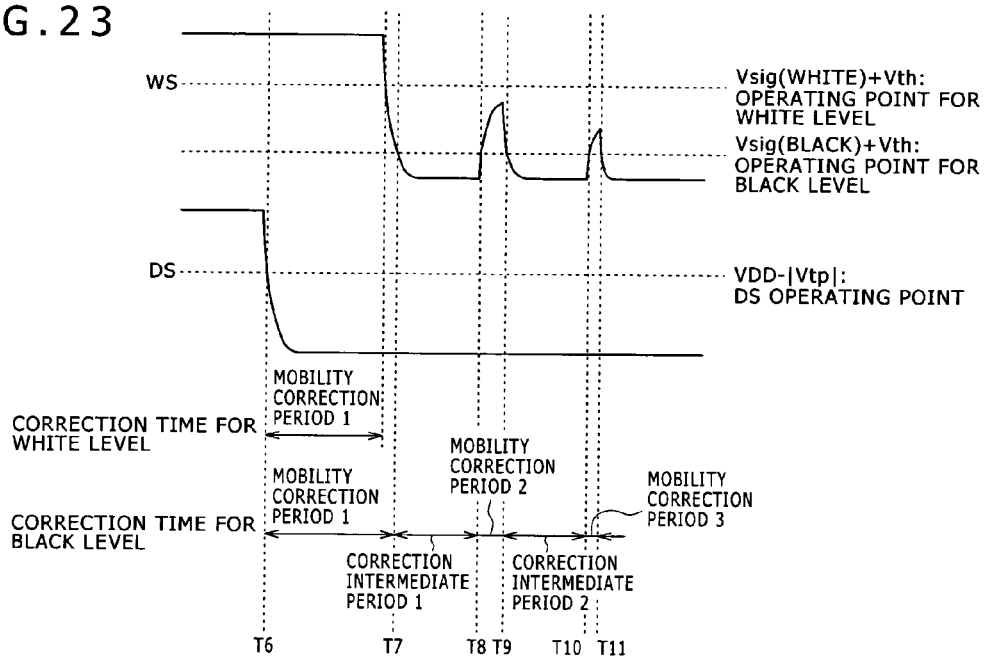
FIG. 23 is a waveform diagram showing yet another modification example of the second embodiment.

FIG. 23 is a waveform diagram showing a fourth modification example of the second embodiment. FIG. 23 employs the same representation manner as that of the waveform diagram of FIG. 22 for the third modification example for easy understanding. The present modification example is different from the third modification example in that the control signal WS including triple pulses is supplied to the scan line WS. The peak levels of the second pulse and the third pulse are set to predetermined levels by adjusting the pulse widths of the respective pulses. In the present modification example, the pulse width of the second pulse (T8 to T9) is larger than the pulse width of the third pulse (T10 to T11). Due to this width design, the peak level of the second pulse is higher than the peak level of the third pulse.

Figure 24:
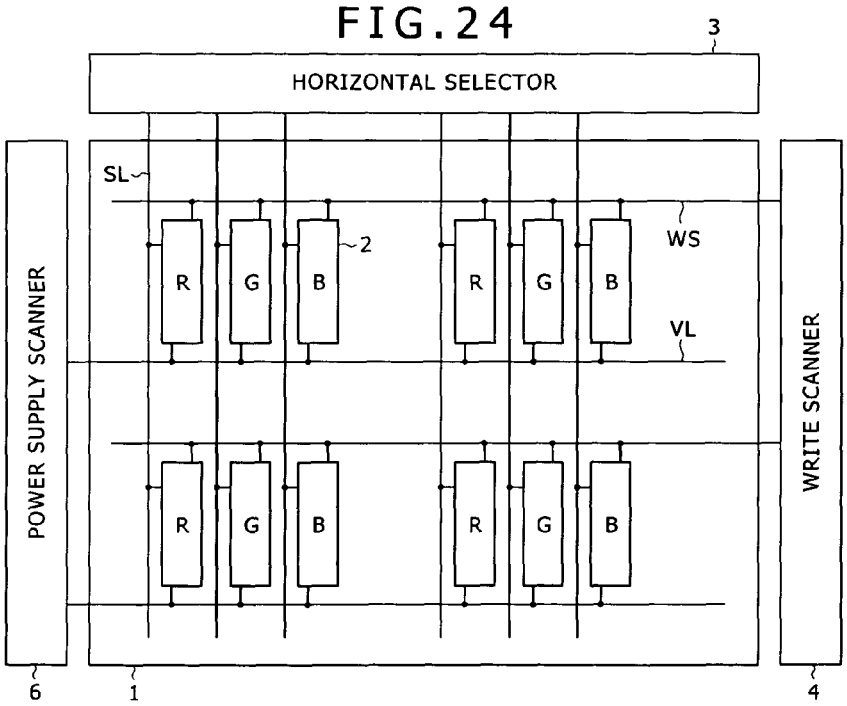
FIG. 24 is an overall block diagram showing another configuration example of the display device according to the embodiment of the present invention.

FIG. 24 is an entire configuration diagram showing a display device according to another embodiment of the present invention. As shown in FIG. 24, this display device includes a pixel array part 1 and a drive part for driving the pixel array part 1. The pixel array part 1 includes scan lines WS along the rows, signal lines SL along the columns, pixels 2 disposed at the intersections of both the lines so as to be arranged in a matrix, and power feed lines (power supply lines) VL disposed corresponding to the respective rows of the pixels 2. In the present example, any of RGB (Red, Green, and Blue) three primary colors is allocated to each of the pixels 2, and thus color displaying is possible. However, the embodiment is not limited thereto but encompasses devices of single-color displaying. The drive part includes a write scanner 4, a power supply scanner 6, and a signal selector (horizontal selector) 3. The write scanner 4 sequentially supplies a control signal to the respective scan lines WS to thereby line-sequentially scan the pixels 2 on a row-by-row basis. The power supply scanner 6 provides a supply voltage that is to be switched between a first potential and a second potential to the respective power feed lines VL in matching with the line-sequential scanning. The signal selector 3 supplies a signal potential as a drive signal and a reference potential to the column signal lines SL in matching with the line-sequential scanning.

Figure 25:
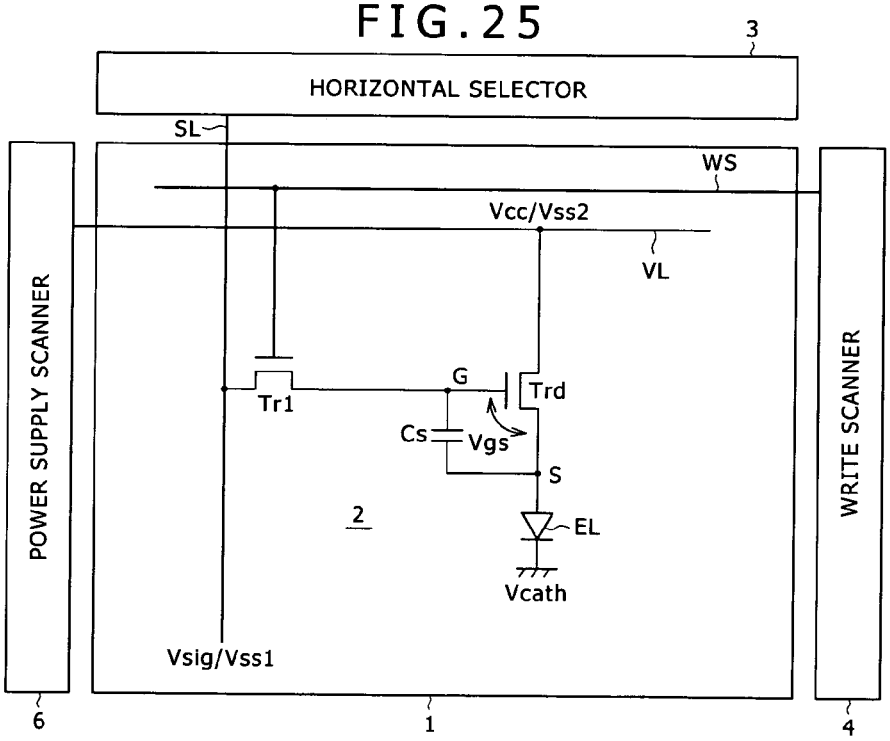
FIG. 25 is a circuit diagram showing the pixel configuration of the display device shown in FIG. 24.

FIG. 25 is a circuit diagram showing the specific configuration and the connection relationship of the pixel 2 included in the display device shown in FIG. 24. As shown in FIG. 25, the pixel 2 includes a light-emitting element EL typified by an organic EL device, a sampling transistor Tr1, a drive transistor Trd, and a holding capacitor Cs. The control terminal (gate) of the sampling transistor Tr1 is connected to the corresponding scan line WS. One of a pair of current terminals (source and drain) of the sampling transistor Tr1 is connected to the corresponding signal line SL, and the other is connected to the control terminal (gate G) of the drive transistor Trd. One of a pair of current terminals (source S and drain) of the drive transistor Trd is connected to the light-emitting element EL, and the other is connected to the corresponding power feed line VL. In the present example, the drive transistor Trd is an N-channel transistor. The drain thereof is connected to the power feed line VL, and the source S thereof is connected as the output node to the anode of the light-emitting element EL. The cathode of the light-emitting element EL is coupled to a predetermined cathode potential Vcath. The holding capacitor Cs is connected between the source S and the gate G, which are one of the current terminals and the control terminal, respectively, of the drive transistor Trd.

In this configuration, the sampling transistor Tr1 is turned on in response to the control signal supplied from the scan line WS, to thereby sample the signal potential supplied from the signal line SL and hold the sampled potential in the holding capacitor Cs. The drive transistor Trd receives current supply from the power feed line VL at the first potential (higher potential Vcc) and applies a drive current to the light-emitting element EL depending on the signal potential held in the holding capacitor Cs. The write scanner 4 outputs the control signal having a predetermined pulse width to the scan line WS so that the sampling transistor Tr1 may be turned on in the time zone during which the signal line SL is at the signal potential. Thereby, the signal potential is held in the holding capacitor Cs, and simultaneously correction relating to the mobility μ of the drive transistor Trd is added to the signal potential. Thereafter, the drive transistor Trd supplies, to the light-emitting element EL, the drive current dependent upon the signal potential Vsig written to the holding capacitor Cs, so that light-emission operation starts.

This pixel circuit 2 has a threshold voltage correction function in addition to the above-described mobility correction function. Specifically, the power supply scanner 6 switches the potential of the power feed line VL from the first potential (higher potential Vcc) to the second potential (lower potential Vss2) at a first timing before the sampling of the signal potential Vsig by the sampling transistor Tr1. Furthermore, the write scanner 4 turns on the sampling transistor Tr1 at a second timing before the sampling of the signal potential Vsig by the sampling transistor Tr1, to thereby apply the reference potential Vss1 from the signal line SL to the gate G of the drive transistor Trd and set the source S of the drive transistor Trd to the second potential (Vss2). The power supply scanner 6 switches the potential of the power feed line VL from the second potential Vss2 to the first potential Vcc at a third timing after the second timing, to thereby hold the voltage equivalent to the threshold voltage Vth of the drive transistor Trd in the holding capacitor Cs. This threshold voltage correction function allows the display device to cancel the influence of variation in the threshold voltage Vth of the drive transistor Trd from pixel to pixel.

The pixel circuit 2 further has a bootstrap function. Specifically, at the timing when the signal potential Vsig has been held in the holding capacitor Cs, the write scanner 4 stops the application of the control signal to the scan line WS to thereby turn off the sampling transistor Tr1 and thus electrically isolate the gate G of the drive transistor Trd from the signal line SL. Due to this operation, the potential of the gate G changes in linkage with potential change of the source S of the drive transistor Trd, which allows the voltage Vgs between the gate G and the source S to be kept constant.

Figure 26:
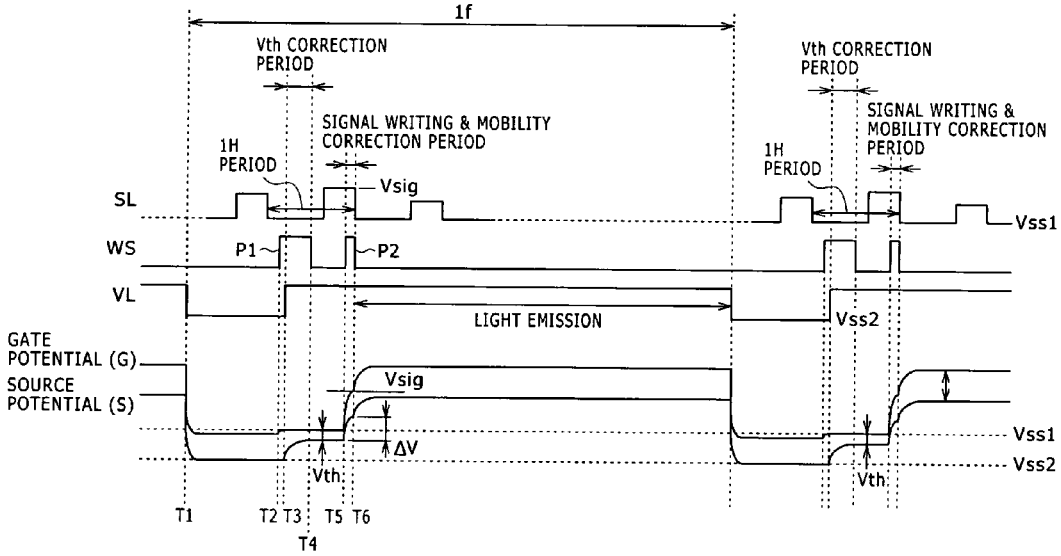
FIG. 26 is a timing chart showing an example of a related-art display device.

FIG. 26 is a timing chart for explaining the operation of the pixel circuit 2 shown in FIG. 25. However, this timing chart shows not an embodiment of the present invention but an example of a related-art technique as the basis of the embodiment. In this timing chart, potential changes of the scan line WS, the power feed line VL, and the signal line SL are shown along the same time axis. In parallel to these potential changes, potential changes of the gate G and the source S of the drive transistor are also shown.

A control signal pulse for turning on the sampling transistor Tr1 is applied to the scan line WS. This control signal pulse is applied to the scan lines WS with the one-field (1*f*) cycle in matching with the line-sequential scanning of the pixel array part. This control signal pulse includes two pulses in one horizontal scanning period (1H). The first pulse and the subsequent pulse will be often referred to as a first pulse P1 and a second pulse P2, respectively. The potential of the power feed line VL is switched between the higher potential Vcc and the lower potential Vss2 with the one-field (1*f*) cycle likewise. To the signal line SL, the drive signal whose potential is switched between the signal potential Vsig and the reference potential Vss1 with a cycle of one horizontal scanning period (1H) is supplied.

As shown in the timing chart of FIG. 26, the operation sequence of the pixel proceeds from the light-emission period of the previous field to the non-light-emission period of the description-subject field, and then proceeds to the light-emission period of the description-subject field. In this non-light-emission period, preparation operation, threshold voltage correction operation, signal writing operation, and mobility correction operation are carried out.

In the light-emission period of the previous field, the power feed line VL is at the higher potential Vcc, and the drive transistor Trd supplies a drive current Ids to the light-emitting element EL. The drive current Ids flows from the power feed line VL at the higher potential Vcc to the drive transistor Trd and passes through the light-emitting element EL toward the cathode line.

At the start of the non-light-emission period of the description-subject field, the potential of the power feed line VL is initially switched from the higher potential Vcc to the lower potential Vss2 at a timing T1. Due to this operation, the power feed line VL is discharged to Vss2, so that the potential of the source S of the drive transistor Trd drops down to Vss2. Thus, the anode potential of the light-emitting element EL (i.e. the source potential of the drive transistor Trd) enters the reverse-bias state, so that the flow of the drive current and hence the light emission are stopped. The potential of the gate G also drops down in linkage with the potential drop of the source S of the drive transistor.

Subsequently, at a timing T2, the potential of the scan line WS is switched from the low level to the high level, which turns on the sampling transistor Tr1. At this time, the signal line SL is at the reference potential Vss1. Therefore, the potential of the gate G of the drive transistor Trd becomes the reference potential Vss1 of the signal line SL via the turned-on sampling transistor Tr1. At this time, the potential of the source S of the drive transistor Trd is at the potential Vss2, which is sufficiently lower than Vss1. In this way, initialization is carried out so that the voltage Vgs between the gate G and the source S of the drive transistor Trd may become higher than the threshold voltage Vth of the drive transistor Trd. The period T1 to T3 from the timing T1 to a timing T3 serves as the preparation period in which the voltage Vgs between the gate G and the source S of the drive transistor Trd is set higher than Vth in advance.

At the timing T3, the potential of the power feed line VL is switched from the lower potential Vss2 to the higher potential Vcc, so that the potential of the source S of the drive transistor Trd starts to rise up. When the voltage Vgs between the gate G and the source S of the drive transistor Trd has reached the threshold voltage Vth in due course, the current is cut off. In this way, the voltage equivalent to the threshold voltage Vth of the drive transistor Trd is written to the holding capacitor Cs. This corresponds to the threshold voltage correction operation. In order that the current does not flow to the light-emitting element EL but flows exclusively toward the holding capacitor Cs during the threshold voltage correction operation, the cathode potential Vcath is so designed that the light-emitting element EL is cut off during the threshold voltage correction operation.

At a timing T4, the potential of the scan line WS returns to the low level from the high level. In other words, the application of the first pulse P1 to the scan line WS is stopped, so that the sampling transistor enters the off-state. As is apparent from the above description, the first pulse P1 is applied to the gate of the sampling transistor Tr1 in order to carry out the threshold voltage correction operation.

Thereafter, the potential of the signal line SL is switched from the reference potential Vss1 to the signal potential Vsig. Subsequently, at a timing T5, the potential of the scan line WS rises up to the high level from the low level again. In other words, the second pulse P2 is applied to the gate of the sampling transistor Tr1. Due to this application, the sampling transistor Tr1 is turned on again so as to sample the signal potential Vsig from the signal line SL. Thus, the potential of the gate G of the drive transistor Trd becomes the signal potential Vsig. Because the light-emitting element EL is initially at the cut-off state (high-impedance state), the current that runs between the drain and the source of the drive transistor Trd flows exclusively toward the holding capacitor Cs and the equivalent capacitor of the light-emitting element EL so as to start charging of these capacitors. Until a timing T6, at which the sampling transistor Tr1 is turned off, the potential of the source S of the drive transistor Trd rises up by ΔV. In this way, the signal potential Vsig of the video signal is written to the holding capacitor Cs in such a manner as to be added to Vth, and the voltage ΔV for the mobility correction is subtracted from the voltage held in the holding capacitor Cs. Therefore, the period T5 to T6 from the timing T5 to the timing T6 serves as the signal writing period and mobility correction period. In other words, in response to the application of the second pulse P2 to the scan line WS, the signal writing operation and the mobility correction operation are carried out. The length of the signal writing period and mobility correction period T5 to T6 is equal to the pulse width of the second pulse P2. That is, the pulse width of the second pulse P2 defines the mobility correction period.

In this manner, the writing of the signal potential Vsig and the adjustment by the correction amount ΔV are simultaneously carried out in the signal writing period T5 to T6. The higher Vsig is, the larger the current Ids supplied by the drive transistor Trd and hence the absolute value of ΔV are. Consequently, the mobility correction dependent upon the light-emission luminance level is carried out. When Vsig is constant, higher mobility μ of the drive transistor Trd provides a larger absolute value of ΔV. In other words, higher mobility μ provides a larger amount ΔV of the negative feedback to the holding capacitor Cs. Therefore, variation in the mobility μ from pixel to pixel can be eliminated.

At the timing T6, the potential of the scan line WS is switched to the low level as described above, so that the sampling transistor Tr1 enters the off-state. This isolates the gate G of the drive transistor Trd from the signal line SL. At this time, the drain current Ids starts to flow through the light-emitting element EL. This causes the anode potential of the light-emitting element EL to rise up depending on the drive current Ids. The rise-up of the anode potential of the light-emitting element EL is equivalent to the rise-up of the potential of the source S of the drive transistor Trd. If the potential of the source S of the drive transistor Trd rises up, the potential of the gate G of the drive transistor Trd also rises up in linkage with the rise-up of the potential of the source S based on the bootstrap operation due to the holding capacitor Cs. The rise amount of the gate potential is equal to that of the source potential. Therefore, in the light-emission period, the input voltage Vgs between the gate G and the source S of the drive transistor Trd is kept constant. The value of this gate voltage Vgs results from the addition of the correction relating to the threshold voltage Vth and the mobility μ to the signal potential Vsig. The drive transistor Trd operates in its saturation region. That is, the drive transistor Trd outputs the drive current Ids dependent upon the input voltage Vgs between the gate G and the source S.

Figure 27:
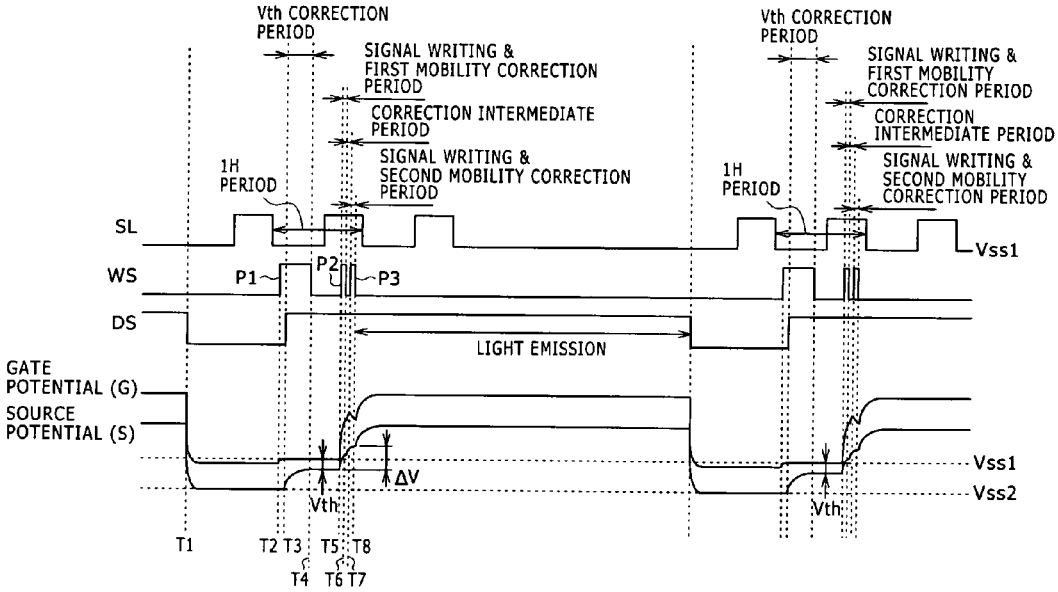
FIG. 27 is a timing chart showing a display device according to a third embodiment of the present invention.

FIG. 27 is a timing chart showing a display device according to a third embodiment of the present invention. The present embodiment arises from improvement of the related-art technique example shown in FIG. 26. FIG. 27 employs the same representation manner as that of FIG. 26 for the related-art technique example for easy understanding. The third embodiment is different from the related-art technique example in the following point. Specifically, in the related-art technique example shown in FIG. 26, the control signal WS includes two pulses P1 and P2. On the other hand, in the third embodiment, the control signal WS includes three control signal pulses P1, P2, and P3. The first pulse P1 defines the threshold voltage correction period, and the second and third control pulses P2 and P3 each define the mobility correction period. Specifically, in the present embodiment, the mobility correction period is divided into two periods based on the double pulses P2 and P3. Furthermore, a correction intermediate period is set between these mobility correction periods to thereby carry out accelerated mobility correction operation. As shown in FIG. 27, of the double pulses, the first pulse P2 corresponds to a first mobility correction period T5 to T6, and the second pulse P3 corresponds to a second mobility correction period T7 to T8. A correction intermediate period T6 to T7 is interposed between both the correction periods.

Figure 28:
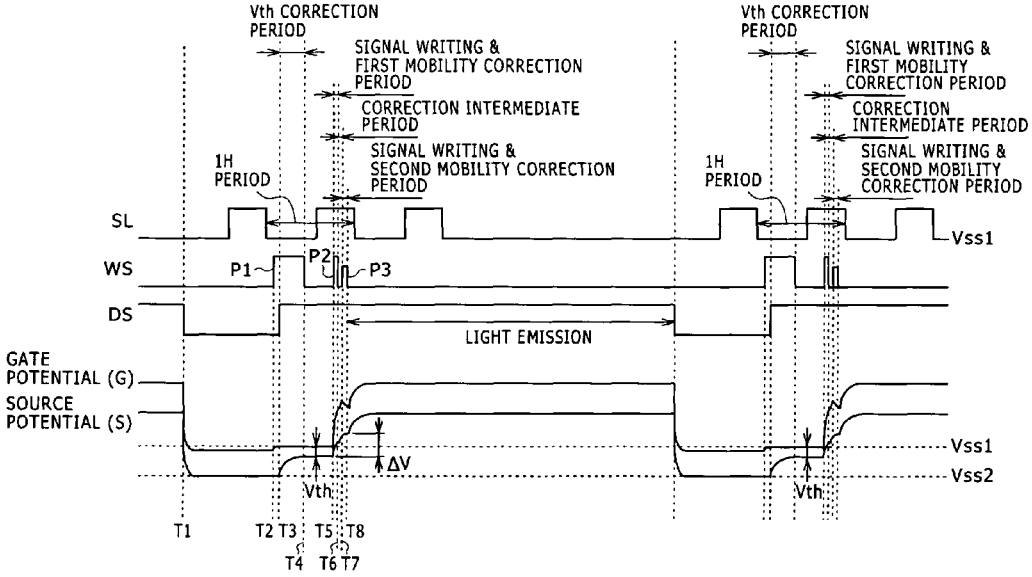
FIG. 28 is a timing chart showing a display device according to a fourth embodiment of the present invention.

FIG. 28 is a timing chart showing a display device according to a fourth embodiment of the present invention. FIG. 28 employs the same representation manner as that of FIG. 27 for the third embodiment for easy understanding. The fourth embodiment is different from the third embodiment of FIG. 27 in that the peak level of the third pulse P3 is set lower than that of the second pulse P2. Also in the present embodiment, mobility correction operation is divided into plural times of operation in the state in which the supply voltage Vdd is supplied to the drain of the drive transistor Trd. Due to this feature, accelerated mobility correction operation can be carried out in the intermediate time of the correction period. In particular, in the present embodiment, the on-voltage (peak level) of each of the divided control pulses P2 and P3 can be varied, and thereby the optimum mobility correction time is designed based on the operating point. Thus, the difference in the correction time can be made based on the operating point corresponding to the grayscale.

Figure 29:
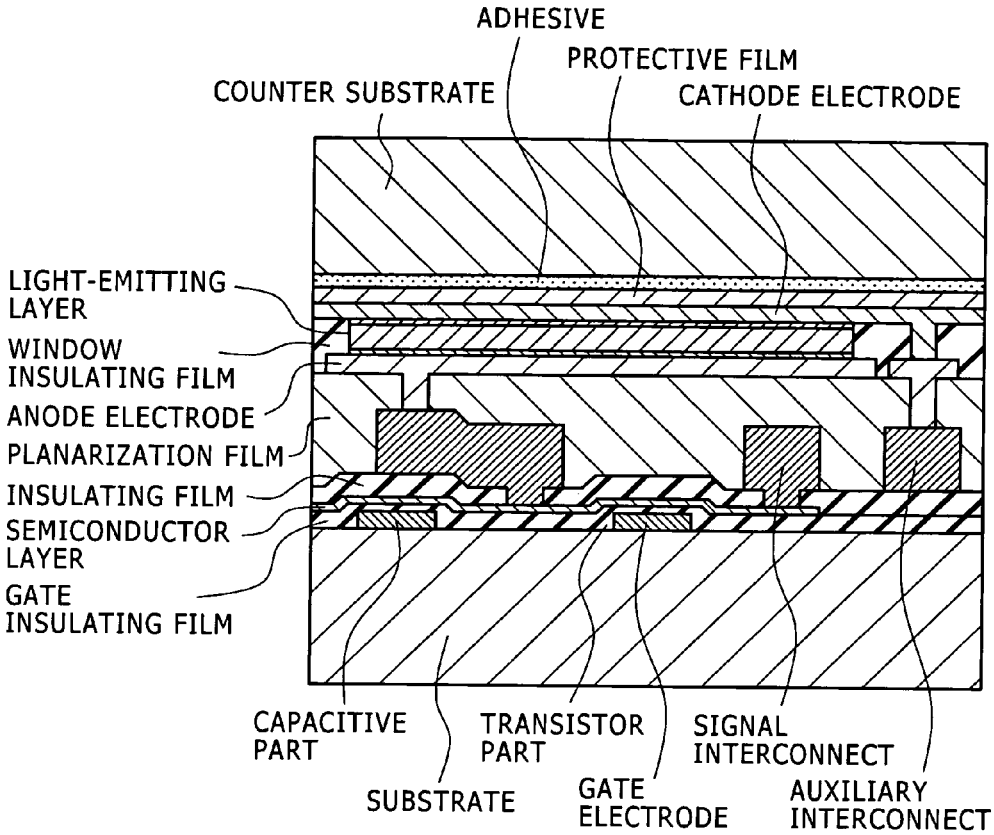
FIG. 29 is a sectional view showing the device structure of the display device according to the embodiment of the present invention.

The display device according to the embodiment of the present invention has a thin film device structure like that shown in FIG. 29. FIG. 29 shows a schematic sectional structure of a pixel formed on an insulating substrate. As shown in FIG. 29, the pixel includes a transistor part having plural thin film transistors (only one TFT is shown in FIG. 29), a capacitive part such as a holding capacitor, and a light-emitting part such as an organic EL element. The transistor part and the capacitive part are formed on the substrate by a TFT process, and the light-emitting part such as an organic EL element is stacked thereon. A transparent counter substrate is attached over the light-emitting part with the intermediary of an adhesive, so that a flat panel is obtained.

Figure 30:
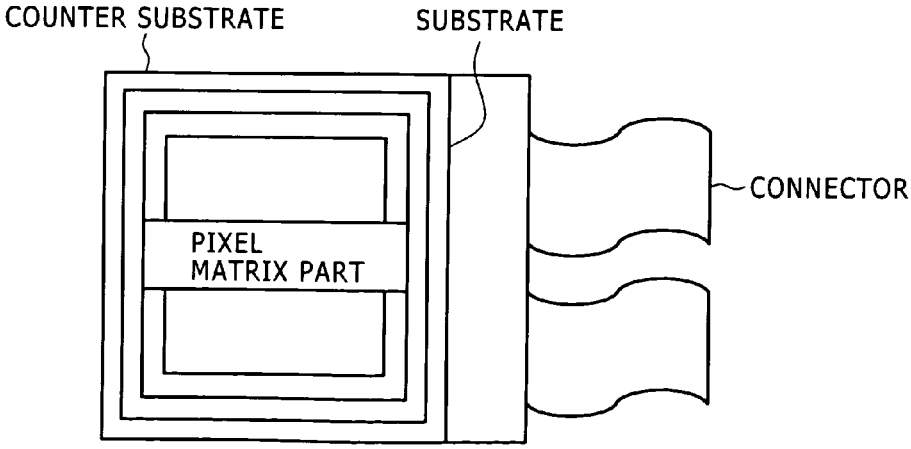
FIG. 30 is a plan view showing the module structure of the display device according to the embodiment of the present invention.

The display device according to the embodiment of the present invention encompasses a display device having a flat module shape like that shown in FIG. 30. For example, the display module is obtained as follows. Specifically, a pixel array part in which pixels each including an organic EL element, thin film transistors, a thin film capacitor, and so on are integrally formed into a matrix is provided on an insulating substrate. Furthermore, an adhesive is disposed to surround this pixel array part (pixel matrix part), and a counter substrate composed of glass or the like is bonded to the substrate. This transparent counter substrate may be provided with e.g. a color filter, protective film, and light-shielding film according to need. The display module may be provided with e.g. a flexible printed circuit (FPC) as a connector for inputting/outputting of signals and so forth to/from the pixel array part from/to the external.

The display device according to any of the above-described embodiments has a flat panel shape, and can be applied to a display in various kinds of electronic apparatus in any field that displays image or video based on a drive signal input to the electronic apparatus or produced in the electronic apparatus, such as a digital camera, laptop personal computer, cellular phone, and video camera. Examples of electronic apparatus to which such a display device is applied will be described below.

Figure 31:
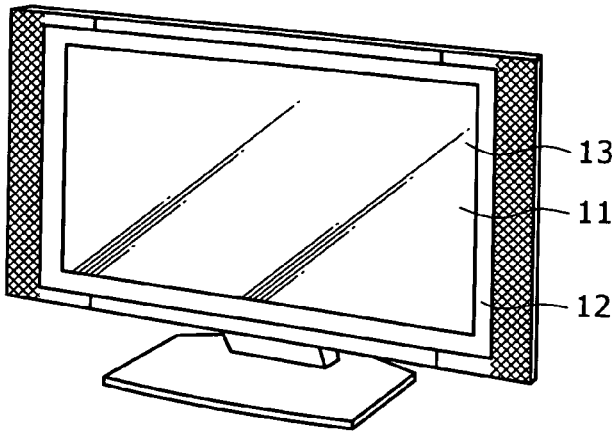
FIG. 31 is a perspective view showing a television set including the display device according to the embodiment of the present invention.

FIG. 31 shows a television to which the embodiment of the present invention is applied. This television includes a video display screen 11 composed of a front panel 12, a filter glass 13, and so on, and is fabricated by using the display device according to the embodiment of the present invention as the video display screen 11.

Figure 32:
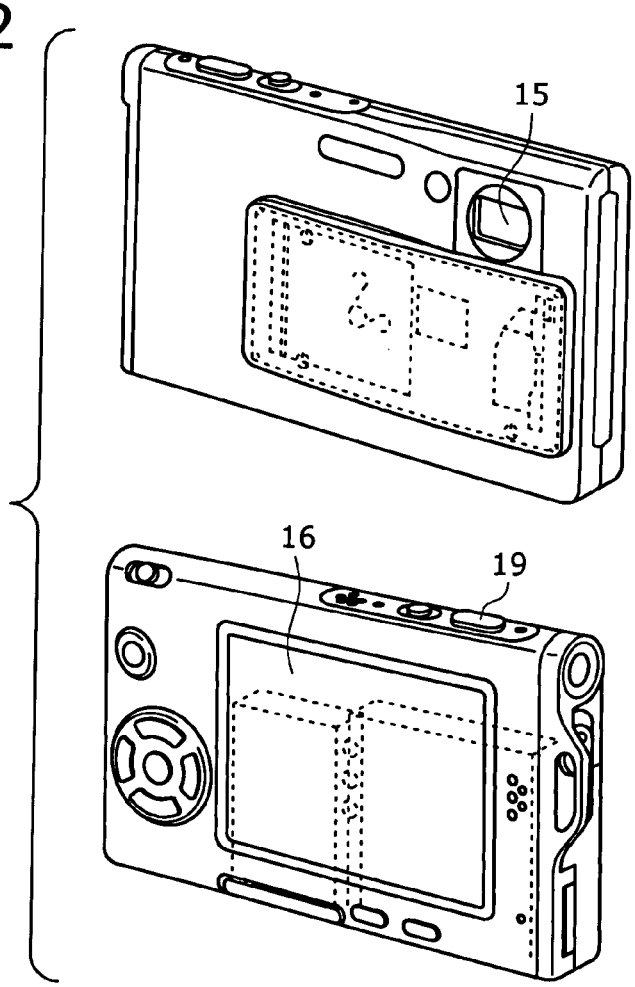
FIG. 32 is a perspective view showing a digital still camera including the display device according to the embodiment of the present invention.

FIG. 32 shows a digital camera to which the embodiment of the present invention is applied: the upper diagram is a front view and the lower diagram is a rear view. This digital camera includes an imaging lens, a light emitter 15 for flash, a display part 16, a control switch, a menu switch, a shutter button 19, and so on, and is fabricated by using the display device according to the embodiment of the present invention as the display part 16.

Figure 33:
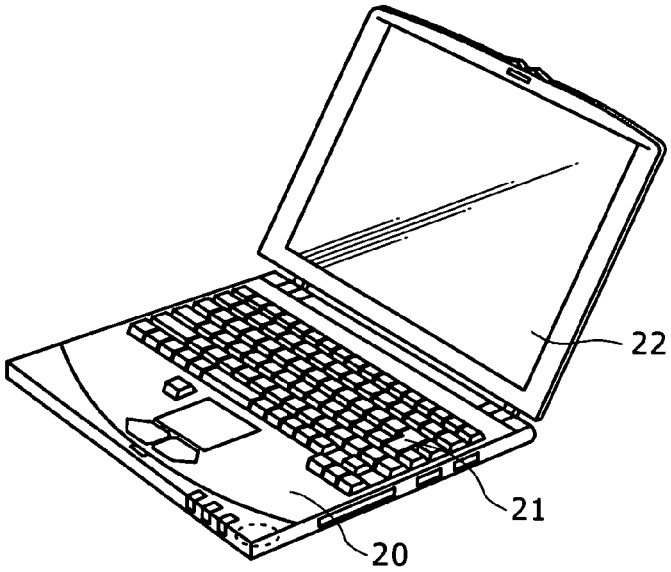
FIG. 33 is a perspective view showing a laptop personal computer including the display device according to the embodiment of the present invention.

FIG. 33 shows a laptop personal computer to which the embodiment of the present invention is applied. A main body 20 thereof includes a keyboard 21 that is operated in inputting of characters and so on, and the body cover thereof includes a display part 22 for image displaying. This laptop personal computer is fabricated by using the display device according to the embodiment of the present invention as the display part 22.

Figure 34:
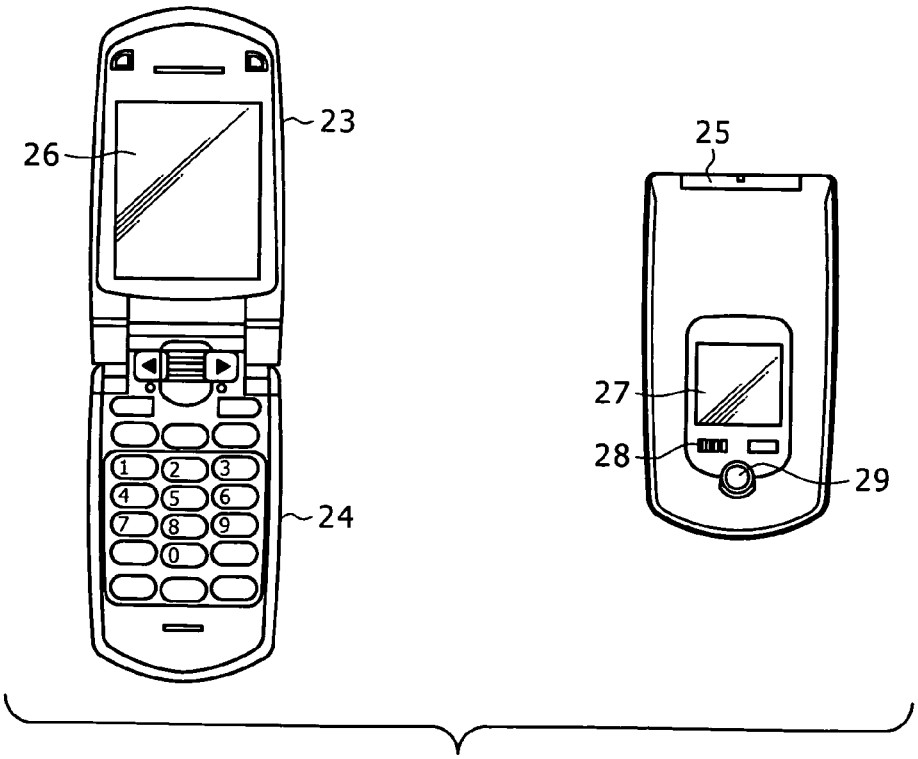
FIG. 34 is a schematic diagram showing portable terminal apparatus including the display device according to the embodiment of the present invention.

FIG. 34 shows portable terminal apparatus to which the embodiment of the present invention is applied: the left diagram shows the opened state and the right diagram shows the closed state. This portable terminal apparatus includes an upper casing 23, a lower casing 24, a connection (hinge) 25, a display 26, a sub-display 27, a picture light 28, a camera 29, and so on. This portable terminal apparatus is fabricated by using the display device according to the embodiment of the present invention as the display 26 and the sub-display 27.

Figure 35:
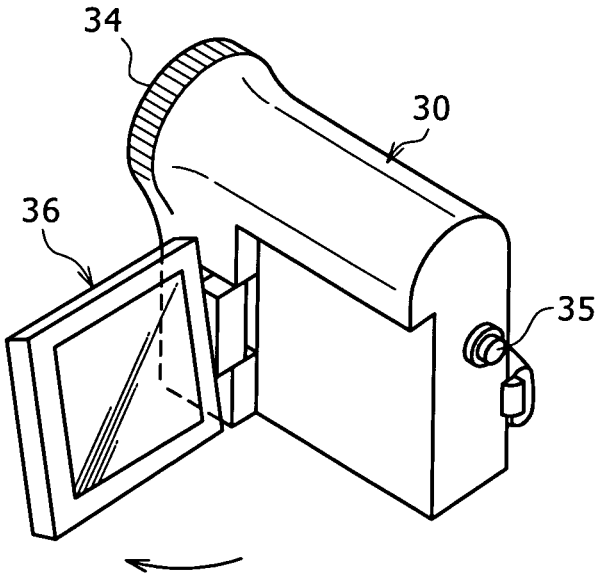
FIG. 35 is a perspective view showing a video camera including the display device according to the embodiment of the present invention.

FIG. 35 shows a video camera to which the embodiment of the present invention is applied. This video camera includes a main body 30, a lens 34 that is disposed on the front side of the camera and used to capture a subject image, a start/stop switch 35 for imaging operation, a monitor 36, and so on. This video camera is fabricated by using the display device according to the embodiment of the present invention as the monitor 36.

It should be understood by those skilled in the art that various modifications, combinations, sub-combinations and alternations may occur depending on design requirements and other factors insofar as they are within the scope of the appended claims or the equivalent thereof.

What is claimed is:

1. A display device comprising:

a pixel array part configured to include scan lines disposed along rows, signal lines disposed along columns, and pixels disposed at intersections of the scan lines and the signal lines; and a drive part configured to have at least a write scanner that sequentially supplies a control signal to the scan lines and a signal selector that supplies a video signal to the signal lines, wherein each of the pixels includes at least a sampling transistor, a drive transistor, a holding capacitor, and a light-emitting element, the sampling transistor is connected between the signal line and the drive transistor, the drive transistor is connected to the light-emitting element and a power supply, the sampling transistor is turned on in response to the control signal supplied to the scan line to thereby sample the video signal from the signal line and write the video signal to the holding capacitor, and the sampling transistor carries out negative feedback of a current that flows from the drive transistor to the holding capacitor to thereby write a correction amount dependent upon mobility of the drive transistor to the holding capacitor in a predetermined correction period until the sampling transistor is turned off in response to a control signal, the drive transistor supplies, to the light-emitting element, the current dependent upon the video signal and the correction amount written to the holding capacitor to thereby cause the light-emitting element to emit light, the write scanner supplies the control signal including at least double pulses to the scan line to thereby set a first correction period, a second correction period, and a correction intermediate period between the first correction period and the second correction period, the first correction period ends and the correction intermediate period starts at a first time and at a second time, the correction intermediate period ends and the second correction period starts, the sampling transistor is turned on during the first correction period and the second correction period, the sampling transistor is turned off throughout the correction intermediate period, the sampling transistor carries out writing of the correction amount to the holding capacitor in the first correction period and accelerates the writing of the correction amount to the holding capacitor in the correction intermediate period, and the sampling transistor settles the writing of the correction amount to the holding capacitor in the second correction period, and a difference between the first time and the second time is shorter for a correction for black level than for a correction for white level.

2. The display device according to claim 1, wherein during the correction intermediate period, the sampling transistor automatically adjusts a degree of acceleration of the writing of the correction amount to the holding capacitor depending on a level of the video signal, to thereby write the correction amount dependent upon the level of the video signal to the holding capacitor.

3. A method for driving a display device including a pixel array part and a drive part; the pixel array part including scan lines disposed along rows, signal lines disposed along columns, and pixels disposed at intersections of the scan lines and the signal lines; each of the pixels including at least a sampling transistor, a drive transistor, a holding capacitor, and a light-emitting element; the sampling transistor being connected between the signal line and the drive transistor; the drive transistor being connected to the light-emitting element and a power supply; the drive part having at least a write scanner that sequentially supplies a control signal to the scan lines to and a signal selector that supplies a video signal to the signal lines; the method comprising:

turning on the sampling transistor in response to the control signal supplied to the scan line to thereby sample the video signal from the signal line and write the video signal to the holding capacitor, and carrying out negative feedback of a current that flows from the drive transistor to the holding capacitor to thereby write a correction amount dependent upon mobility of the drive transistor to the holding capacitor in a predetermined correction period until the sampling transistor is turned off in response to a control signal;

supplying the current dependent upon the video signal and the correction amount written to the holding capacitor from the drive transistor to the light-emitting element, to thereby cause the light-emitting element to emit light;

supplying the control signal including at least double pulses from the write scanner to the scan line to thereby set a first correction period, a second correction period, and a correction intermediate period between the first correction period and the second correction period;

setting a first time when the first correction period ends and the correction intermediate period starts;

setting a second time when the correction intermediate period ends and the second correction period starts;

turning the sampling transistor on during the first correction period and the second correction period;

turning the sampling transistor off throughout the correction intermediate period;

carrying out writing of the correction amount to the holding capacitor in the first correction period, accelerating the writing of the correction amount to the holding capacitor in the correction intermediate period, and settling the writing of the correction amount to the holding capacitor in the second correction period, by the sampling transistor; and setting a difference between the first time and the second time shorter for a correction for black level than for a correction for white level.

4. An electronic apparatus comprising the display device according to claim 1.

5. The method according to claim 3, wherein during the correction intermediate period, the sampling transistor automatically adjusts a degree of acceleration of the writing of the correction amount to the holding capacitor depending on a level of the video signal, to thereby write the correction amount dependent upon the level of the video signal to the holding capacitor.

* * * * *